US006578587B2

(12) United States Patent
Matsuno et al.

(10) Patent No.: US 6,578,587 B2
(45) Date of Patent: Jun. 17, 2003

(54) DISH WASHING MACHINE HAVING UPPER DOOR AND LOWER DOOR WITH SEALING MEMBER

(75) Inventors: Tomohiko Matsuno, Moriguchi (JP); Tetsuo Harada, Moriguchi (JP); Yasuhisa Fukui, Moriguchi (JP)

(73) Assignee: Sanyo Electric Co., Ltd., Osaka (JP)

( * ) Notice: Subject to any disclaimer, the term of this patent is extended or adjusted under 35 U.S.C. 154(b) by 147 days.

(21) Appl. No.: 09/770,612

(22) Filed: Jan. 29, 2001

(65) Prior Publication Data

US 2001/0013357 A1 Aug. 16, 2001

(30) Foreign Application Priority Data

Jan. 31, 2000 (JP) ..... 2000-022460
Apr. 18, 2000 (JP) ..... 2000-117117

(51) Int. Cl.[7] ..... B08B 3/00; A47L 17/02

(52) U.S. Cl. ..... 134/57 DL; 134/58 DL; 134/200; 312/222; 312/228.1; 312/324; 312/326

(58) Field of Search ..... 134/56 D, 57 D, 134/57 DL, 200, 201; 312/222, 228, 228.1, 324, 326

(56) References Cited

U.S. PATENT DOCUMENTS 3,910,499 A * 10/1975 Trouilhet ..... 134/176
5,001,809 A * 3/1991 Kim et al. ..... 16/62

FOREIGN PATENT DOCUMENTS

| | | | |
|---|---|---|---|
| JP | 09-164102 | | 6/1997 |
| JP | 09206268 A | * | 8/1997 |
| JP | 2001299661 A | * | 8/2001 |
| JP | 2001321313 A | * | 11/2001 |
| JP | 2001327453 A | * | 11/2001 |
| JP | 20011327451 A | * | 11/2001 |
| JP | 2002065555 | * | 3/2002 |

* cited by examiner

*Primary Examiner*—Randy Gulakowski
*Assistant Examiner*—Joseph Perrin
(74) *Attorney, Agent, or Firm*—Rabin & Berdo, PC

(57) ABSTRACT

A dish washing machine according to the present invention has vertically divided upper and lower doors 16 and 17 for covering an opening of a washing chamber. The upper door 16 is opened through its upward pivotal movement about its shafts 20. The lower door 17 is opened through its downward pivotal movement about its shafts 22. The upper door 16 is fully opened through its pivotal movement substantially through 180 degrees. The lower door 17 is opened to a substantially horizontal position. And when the lower door 17 is in this opened state, a basket 4 contained in the washing chamber 3 can be pulled out onto the lower door 17.

15 Claims, 20 Drawing Sheets

DISH WASHING MACHINE HAVING UPPER DOOR AND LOWER DOOR WITH SEALING MEMBER

This application is based on applications No. 2000-22460 and No. 2000-117117 filed in Japan.

BACKGROUND OF THE INVENTION

1. Field of the Invention

The present invention relates to a dish washing machine for washing dishes and the like.

2. Description of Prior Art

A home dish washing machine, for example, includes a sealable washing chamber, in which dishes are supported by a basket. Further, an opening is provided in the front surface of the washing chamber through which dishes are put into and out of the washing chamber, and a door for covering the opening is provided.

The door is formed of a rectangular single plate and is pivotally supported. A pivotal shaft for this door is provided at the lower end of the door. The door is opened forward to a substantially horizontal position. The basket is pulled onto the opened door, and dishes are put into or out of the basket wholly mounted on the opened door.

However, a conventional dish washing machine requires a large space for opening a door, and therefore, the installation location and orientation of such a conventional dish washing machine is limited. For example, it cannot be installed sideways on a sink plate. This is because, if it is installed sideways on a sink plate, the doer, when opened, bumps against a water tap or the like.

SUMMARY OF THE INVENTION

Therefore, an object of the present invention is to solve the above-mentioned technical problems and provide a dish washing machine capable of being installed regardless of location and orientation.

Another object of the present invention is to provide a dish washing machine that facilitates the putting in and out of dishes.

A dish washing machine according to the present invention has vertically divided two doors, namely, an upper door and a lower door for covering an opening of a washing chamber. The upper door is pivotally moved upward about a shaft provided at its upper part. And the lower door is pivotally moved downward about a shaft provided at its lower part.

The lower door can be opened to a substantially horizontal position, and a basket pulled out from the washing chamber can be partly placed on the opened lower door. The upper door can be fully opened with its pivotal movement to an angle of approximately 180 degrees from the closed position, but can be stopped at a position at a smaller angle than 180 degrees, for example, 150 degrees.

The upper and the lower doors are so constructed that firstly the lower door can be opened and then the upper door can be opened. For closing the doors, the operation is carried out in reverse order, that is, firstly the upper door is closed and then the lower door is closed.

The abovementioned objects and structures of the present invention will become more apparent from the following detailed description of embodiments given with reference to the appended drawings.

DESCRIPTION OF PREFERRED EMBODIMENTS

Figure 1:
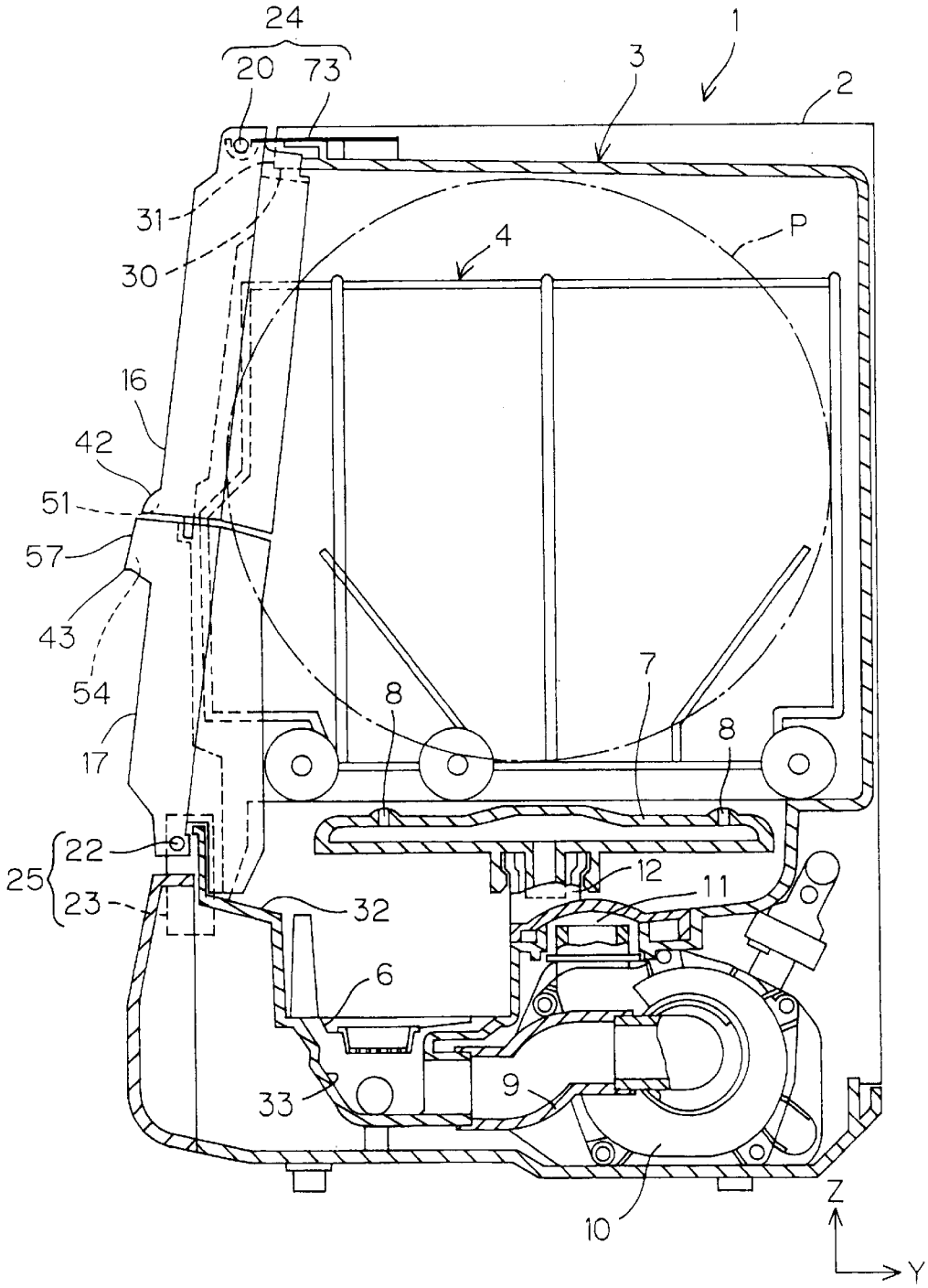
FIG. 1 is a sectional side view of a dish washing machine according to an embodiment of the present invention.
Figure 2:
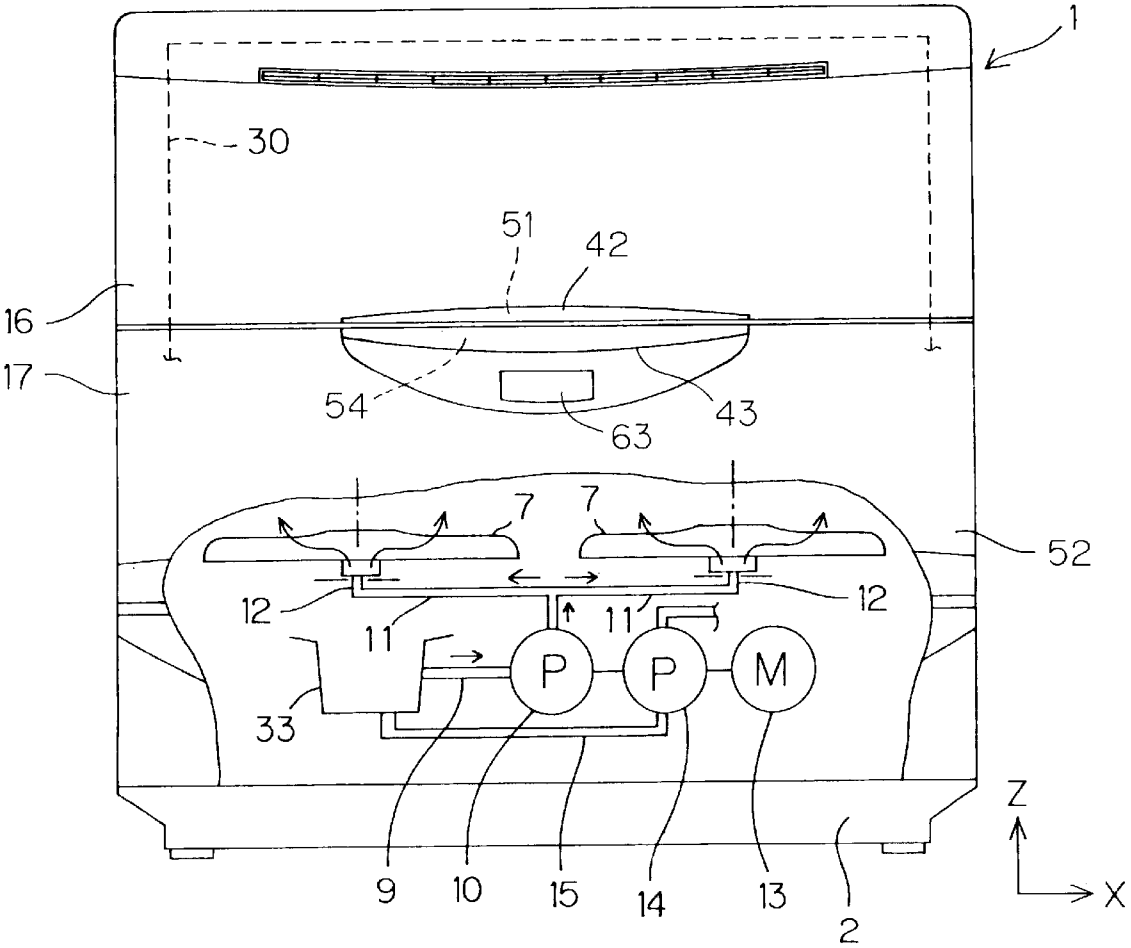
FIG. 2 is a front view of the dish washing machine according to the embodiment of the present invention.

FIG. 1 is a sectional side view of a dish washing machine according to an embodiment of the present invention. FIG. 2 is a front view of the dish washing machine of FIG. 1. In these figures, arrows X, Y and Z indicate directions. Arrows X, Y and Z are also shown in FIG. 3 and subsequent figures.

The dish washing machine 1 includes a cabinet 2 having in a washing chamber 3 formed therein for washing dishes and the like P. In the washing chamber 3, a basket 4 for supporting dishes is removably contained. In a front surface 31 of the washing chamber 3, is an opening 30 through which dishes are put into and out of the washing chamber 3. Further, an upper door 16 and a lower door 17 are provided. The opening 30 is sealed with the upper door 16 and the lower door 17 when dishes are washed. In the washing chamber 3, two spray arms 7 are provided below the basket 4. Each of the spray arms 7 is provided with nozzles 8 through each of which wash water is sprayed.

Wash water is supplied to the washing chamber 3 from an outside water supply installation (not shown) such as waterworks. Pipes, valves and the like (not shown) for supplying water are provided below the washing chamber 3. Wash water can be stored in the bottom part 32 of the washing chamber 3. The bottom part 32 of the washing chamber 3 has a water storing section 33 at a lower portion thereof. The water storing section 33 is provided with a filter 6 at an inlet opening thereof and is connected through a pipe 9 to a washing pump 10. An outlet port of the washing pump 10 is connected through pipes 11, 12 to the spray arms 7. When the washing pump 10 is operated by a motor 13, wash water is sucked from the water storing section 33 and supplied under pressure to the spray arms 7. Each of the spray arms 7 is supported rotatably about a vertical shaft and is rotated by a reaction force of the spraying force of wash water and especially a horizontal component thereof. Dishes are sprayed with wash water and are uniformly washed. Then, the wash water returns to the bottom part 32 of the washing chamber 3 and recycled through the washing pump 10 and spray arms 7, whereby dishes are washed. After washing is completed, the wash water is drained through a drain pipe 15 by a drain pump 14.

A dish washing machine 1 according to the present invention has a substantially rectangular outer shape in a plan view. In concrete, the outer shape of a dish washing machine according to the present invention is short in depth (in the direction of arrow Y) and long in width (in the direction of arrow X). In correspondence with the outer shape of the dish washing machine 1, the outer shapes of the washing chamber 3 and the basket 4 are similarly short in depth and long in width respectively. The front surface of the cabinet 2 extends a little obliquely upward, and the upper door 16 and the lower door 17 are provided there. The two spray arms 7 are arranged in the direction of the width. The pipe 11 is bifurcated and connects the two spray arms 7 with the outlet port of the washing pump 10.

By providing a dish washing machine with the above-mentioned outer shape, a dish washing machine 1 of a thin type in depth can be realized. As a result, a dish washing machine 1 according to the present invention can be installed in a space in which a conventional dish washing machine having a substantially square outer shape in a plan view cannot be installed. For example, a dish washing machine 1 according to the present invention can be installed sideways at a corner of a sink plate.

The dish washing machine 1 includes vertically divided two doors, namely, the upper door 16 and the lower door 17. Therefore, a space required for opening the upper and the lower doors 16, 17 can be reduced. Further, since the basket 4 can be placed on the lower door 17, dishes can be easily put in and out.

Figure 10:
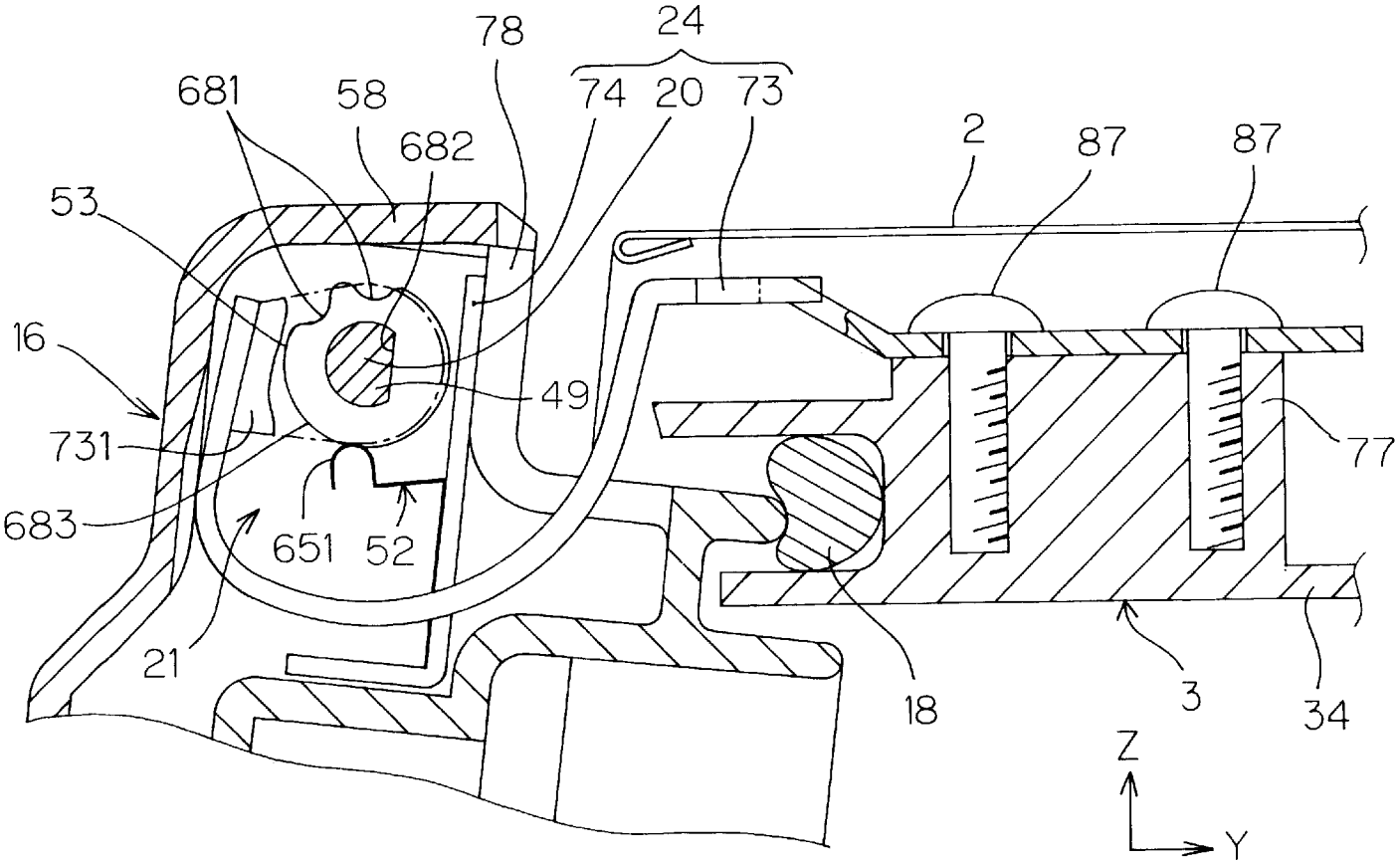
FIGS. 10 to 12 are views illustrating operations of a stop mechanism used when the upper door is opened.
Figure 11:
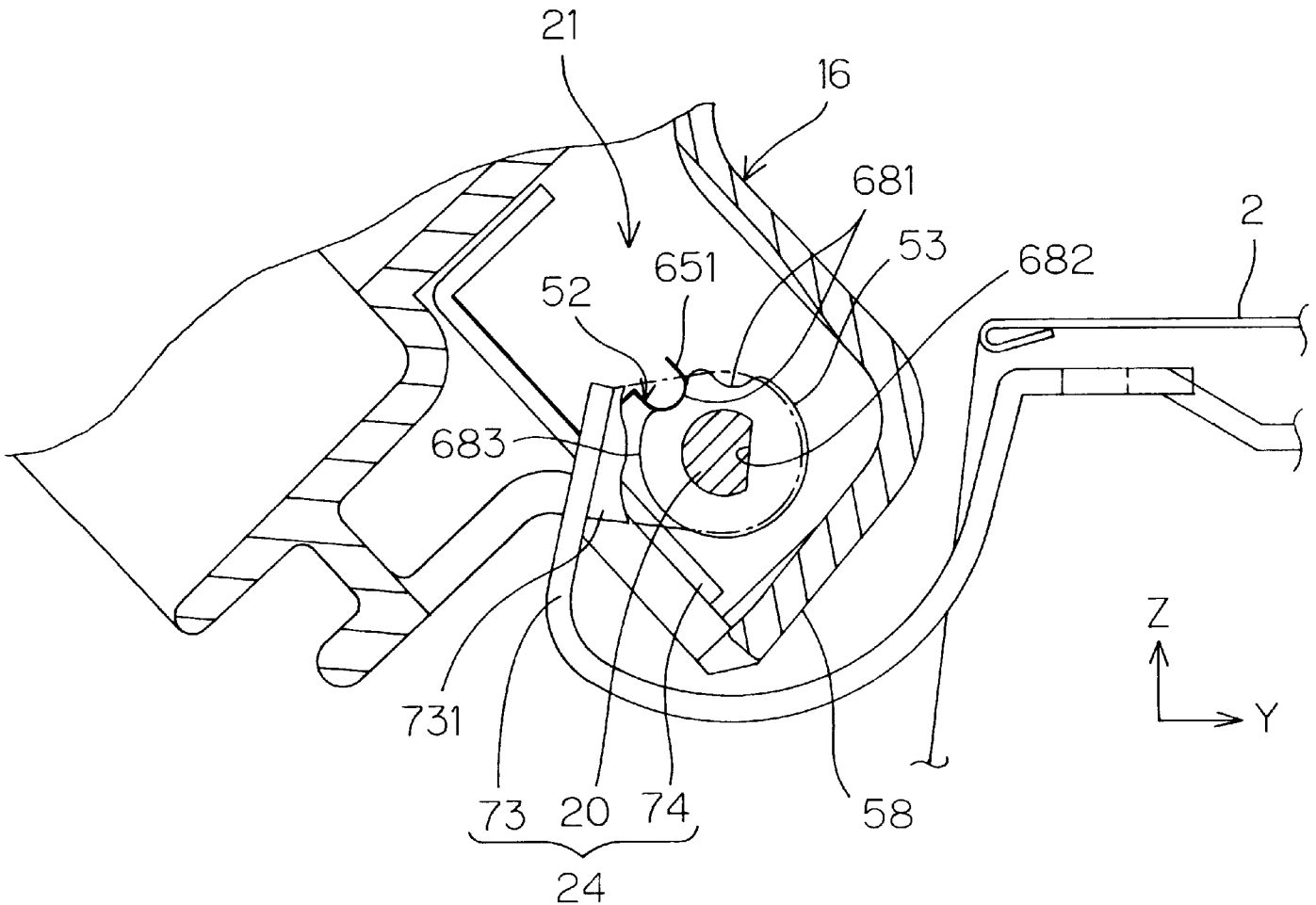
Figure 12:
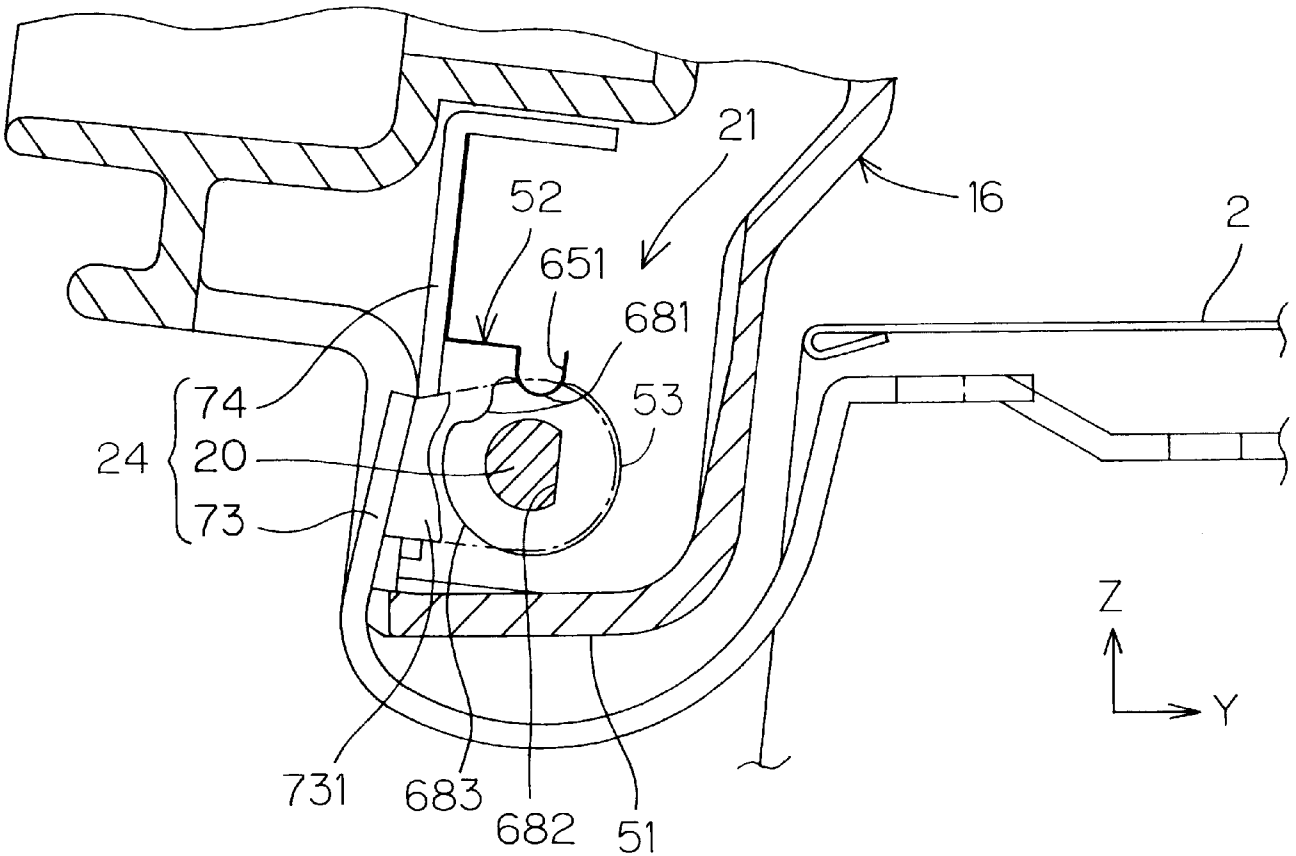

There are provided gaskets 18, 19 (partly shown in FIGS. 10 and 18) for sealing spaces between peripheral parts of the opening 30 and the upper and the lower doors 16, 17. The gasket 18 is provided on the upper peripheral part of the opening 30 and the gasket 19 is on the lower peripheral part thereof. The gaskets 18, 19 coact to enclose the opening 30. Further, a sealing member 81 (see FIG. 16) is provided between the upper door 16 and the lower door 17. The sealing member 81 will be described later in detail.

The upper door 16 is pivotally supported by a pair of upper hinges 24, and similarly, the lower door 17 is pivotally supported by a pair of lower hinges 25. Each of the lower hinges 25 has a shaft 22 and support fittings 23. Each of the upper hinges 24 has a shaft 20, a first support member 73 and the second support member 74 (see FIG. 16).

When forwardly pulled, the lower door 17 pivotally moves downwards about the shafts 22 and is opened. The shafts 22 are fixed to the lower portion of the lower door 17 and project horizontally to the right and the left. The support fittings 23 are fixed to both sides below the opening 30 and pivotally support the shafts 22 respectively.

When forwardly pulled, the upper door 16 pivotally moves upward about the shafts 20 and is opened. The vertical length of the lower door 17 is a little smaller than that of the upper door 16.

The upper door 16 and the lower door 17 have handles 42, 43, respectively.

The handle 42 of the upper door 16 is provided at a lower end portion of the upper door 16 and has a recess 51 into which user's fingers are put.

The handle 43 of the lower door 17 is provided at the upper end portion of the lower door 17 and has a recess 54 into which a user's fingers are put.

Further, in order to ensure that the upper door 16 is opened after the lower door 17 has been opened, that is, the upper door 16 is prevented from being opened before the lower door 17 is opened, the handle 43 of the lower door 17 is provided with a cover 57 (operation preventing member) which covers the recess 51 of the handle 42 of the upper door 16. When the upper and the lower doors 16, 17 are closed, the cover 57 covers at least a part of the handle 42 so that a user's fingers cannot hold the handle 42.

Figure 3C:
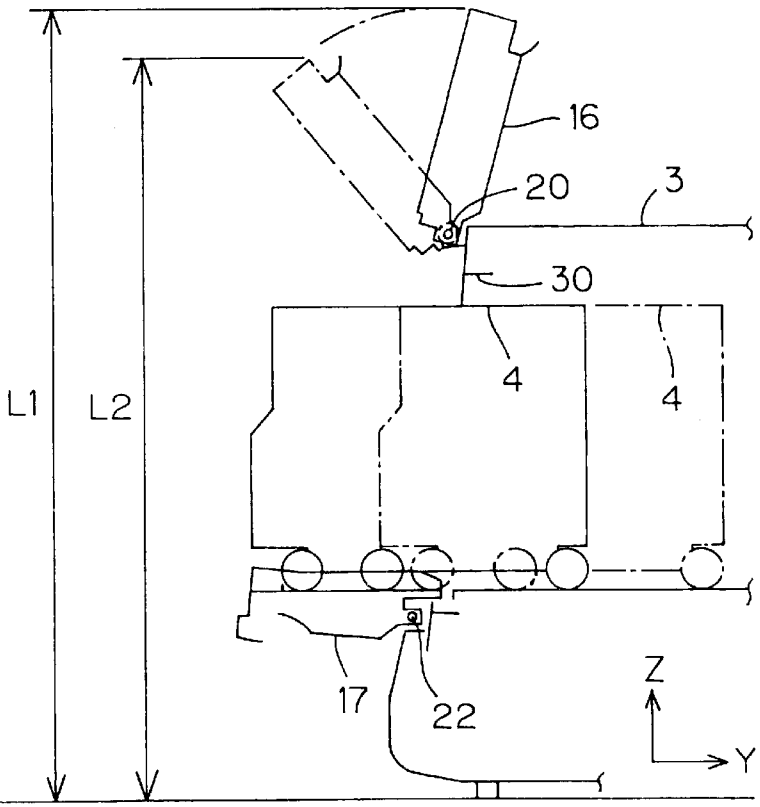
FIGS. 3A to 3C are views illustrating operations of opening an upper door and a lower door.
Figure 3B:
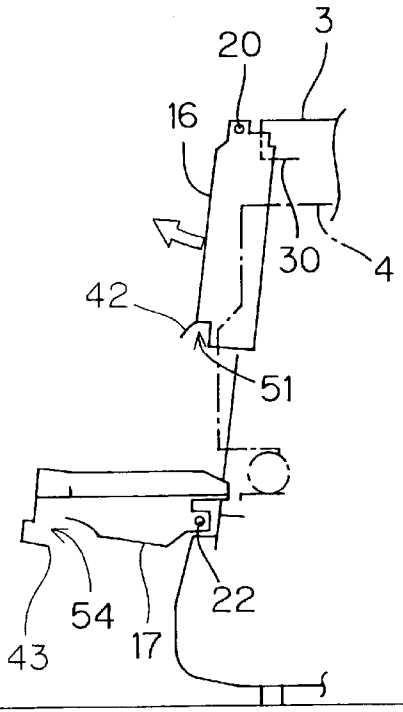
Figure 3A:
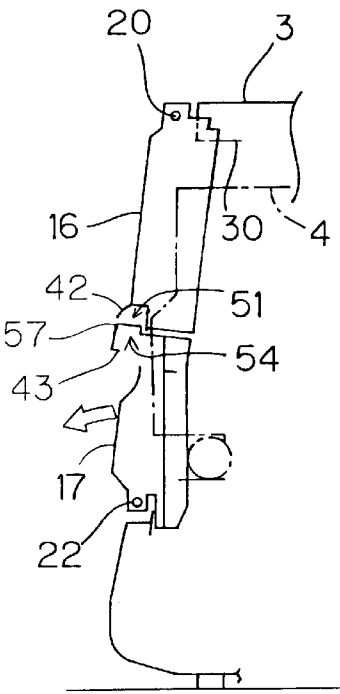

Referring now to FIGS. 3A–3C, operations of opening the upper and the lower doors 16, 17 will be described below.

In the closed state, the upper and the lower doors 16, 17 coact to seal the opening 30 as shown in FIG. 3A.

For opening, firstly the lower door 17 is opened and then the upper door 16 is opened as shown in FIG. 3B. The lower door 17 is pivotally moved substantially through 90 degrees about the shafts 22 and thereby opened. In the opened state, the back surface (the surface on the side of the washing chamber 3 in the closed state) of the lower door 17 is substantially horizontal.

When the lower door 17 is opened, the user can hold the handle 42 of the upper door 16. The handle 42 is pulled forwardly and thereby the upper door 16 is opened.

The upper door 16 is pivotally moved substantially through 180 degrees about the shafts 20 as shown in a solid line in FIG. 3C and opened. Further, the upper door 16 can be stopped after it is pivotally moved substantially by an angle of 150 degrees as shown in a dot and dash line in FIG. 3C.

When the upper door 16 and the lower door 17 are opened, the basket 4 can be pulled out of the washing chamber 3 onto the back surface of the lower door 17, as shown in FIG. 3C. Then, the pulled out basket 4 can be removed therefrom.

During the operation of opening the upper door 16, sometimes water drops fall down from the back surface of the upper door 16. However, in this embodiment, since the lower door 17 is firstly opened, the lower door 17 can receive water drops falling during the operation of opening the upper door 16.

Further, the shaft of the upper door is provided more rearward than that of the lower door so that the most front edge of the upper door is positioned behind the front edge of the lower door in its opened state.

Figure 4:
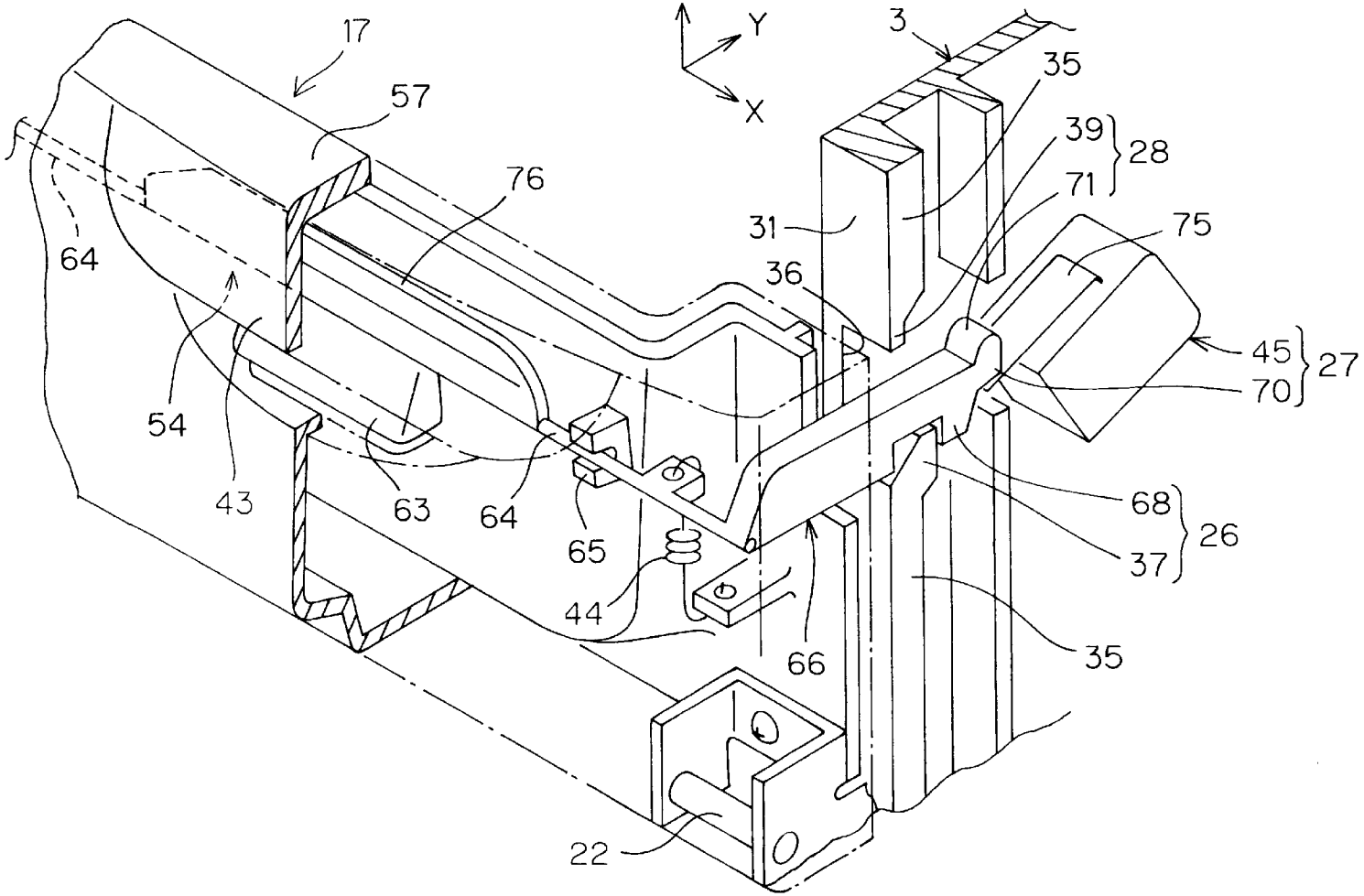
FIG. 4 is a partial sectional perspective view of a washing chamber and the lower door.

FIG. 4 is a partly sectioned perspective view of the washing chamber 3 and the lower door 17.

The lower door 17 has a pair of locking mechanisms 26 disposed on its right and left sides, and pair of switch mechanism 27 for stopping the washing operation when the lower door 17 is opened. The switch mechanism 27 may be provided on either one of the right or left sides. Further, a push button 63 (operating member) is provided near the handle 43. Now, the locking mechanism 26 on the right side will be described below. The locking mechanism 26 on the left side has a similar structure.

The push button 63 is disposed in the recess 54 of the handle 43. The push button 63 is connected with a shaft 64 extending to the right and the left and can pivotally move the shaft 64. The shaft 64 is supported by a support portion 65 of the lower door 17. The right end of the shaft 64 is connected to an arm 66. The arm 66 is extended rearward from the shaft 64 and a rear part 67 of the arm 66 is disposed behind a cut-away portion 36 of a rib 35 of the washing chamber 3. Through the pivotal movement of the shaft 64, the arm 66 is shifted to a lower position in which the rear part 67 is relatively low and to an upper position in which the rear part 67 is relatively high. Further, the shaft 64 is provided with a spring 44 for urging the arm 66 toward the lower position.

The locking mechanism 26 includes a downward hook 68 formed on the arm 66 and a lower engaging portion 37 of a rib 35 of the washing chamber 3.

The rib 35 is extended in the vertical direction (direction of arrow Z) on the front side surface of the washing chamber 3. The rib 35 is provided with the abovementioned cut-away portion 36, through which the arm 66 passes. The lower engaging portion 37 is positioned below the cut-away portion 36.

Figure 5:
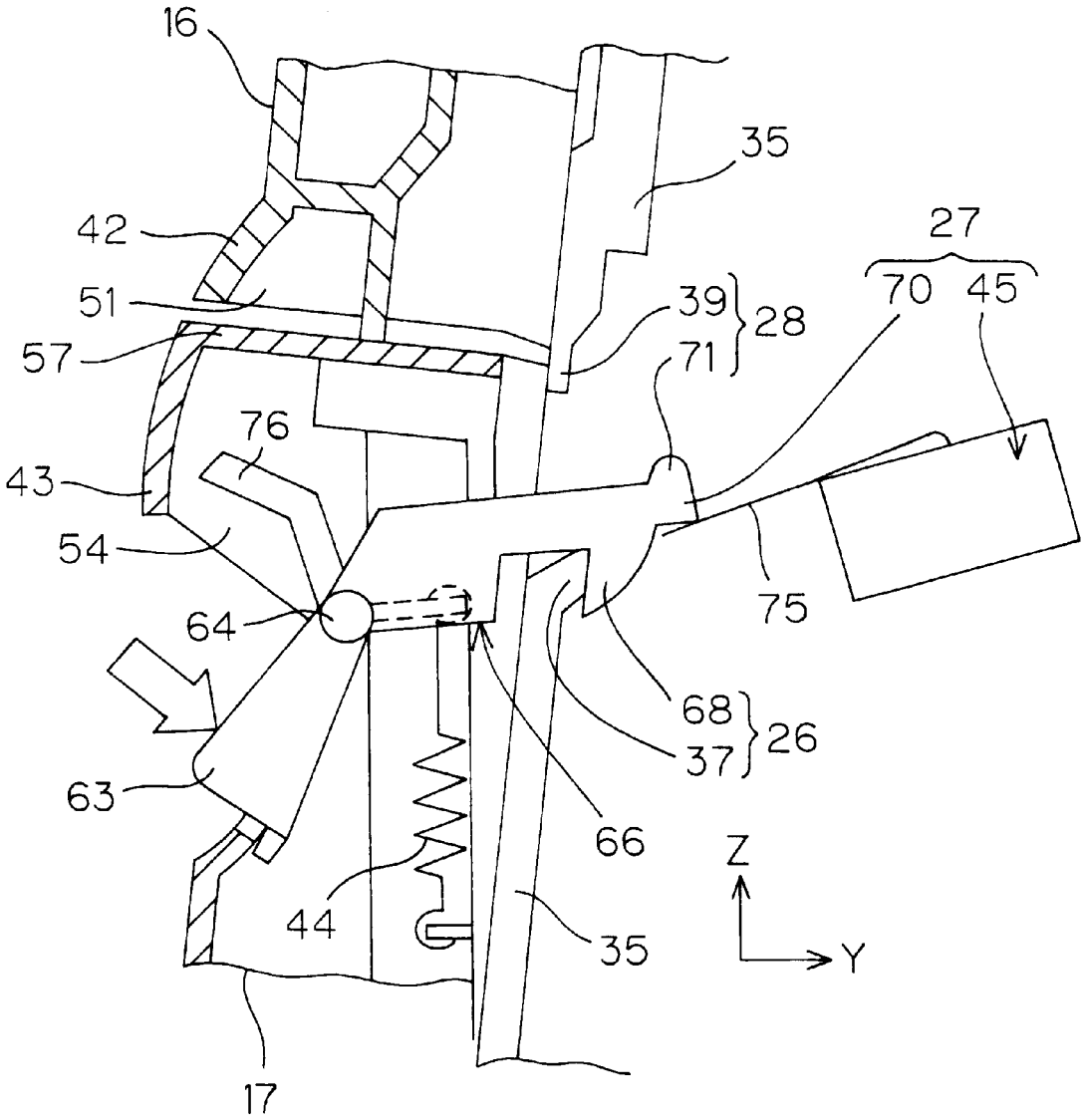
FIGS. 5 to 8 are views illustrating operations of a locking mechanism and a switch mechanism used when the lower door is opened.
Figure 6:
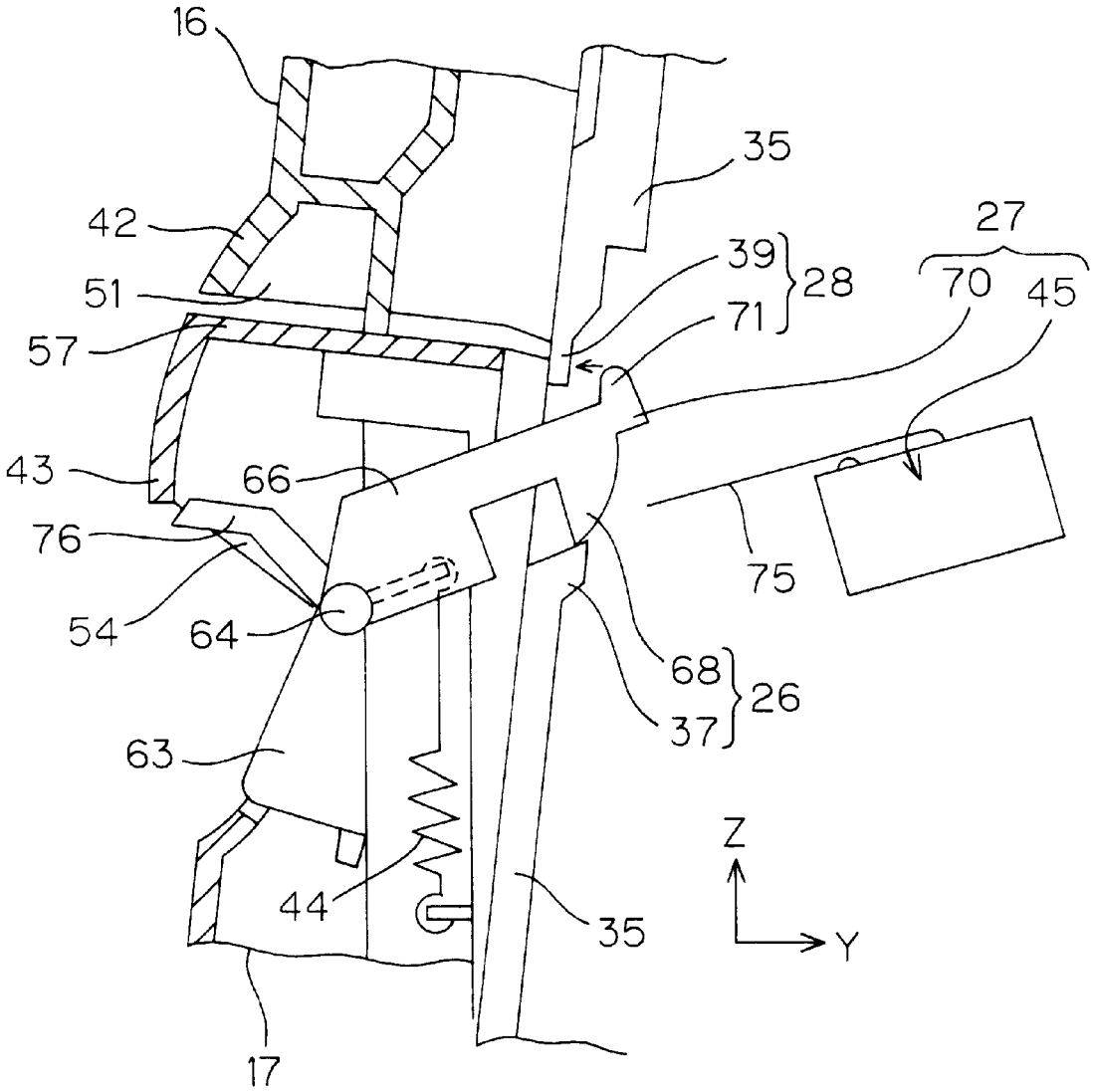

As shown in FIG. 5, when the lower door 17 is closed, the hook 68 of the arm 66 in the lower position is engaged with the lower engaging portion 37 of the rib 35. When the push button 63 is pushed, the arm 66 moves to the upper position, and the hook 68 is disengaged from the lower engaging portion 37 as shown in FIG. 6. As a result, the lower door 17 is slightly opened by an elastic expansion force of the unshown gasket (see FIG. 7).

The switch mechanism 27 includes a microswitch 45 connected to a control circuit (not shown) for controlling the operation of the washing pump 10, and a rear end protruded portion 70 for pressing an actuator 75 of the microswitch 45.

As shown in FIG. 5, the rear end protruded portion 70 of the arm 66 in the lower position presses down the actuator 75. When the arm 66 is in the upper position, the rear end protruded portion 70 is separated from the actuator 75 as shown in FIG. 6.

When the actuator 75 of the microswitch 45 is pressed down, the washing pump 10 is operable. When the actuator 75 is released from being pressed down, an electric current flowing to a motor 13 for driving the washing pump 10 is interrupted, and the washing operation is stopped.

Figure 7:
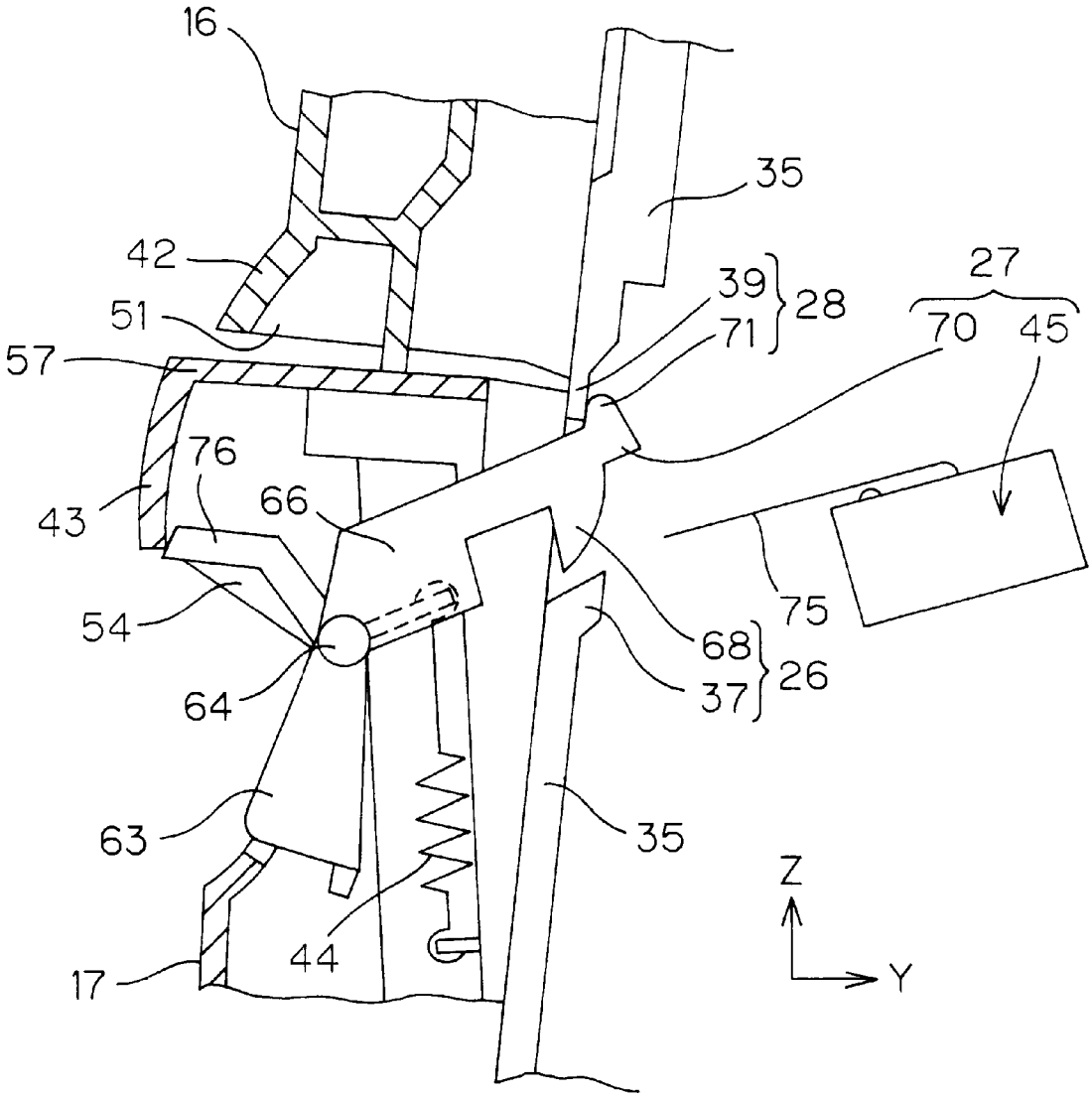

As shown in FIG. 7, even if locking of the locking mechanism 26 is released, the engaging mechanism 28 prevents the lower door 17 from being immediately opened.

The engaging mechanism 28 includes a projection 71 projected upward from the rear part of the arm 66, and an upper engaging portion 39 of the rib 35 of the washing chamber 3. When the arm 66 is in the upper position, the projection 71 engages with the upper engaging portion 39 (see FIG. 7).

In the state shown in FIG. 7, the locking of the locking mechanism 26 is released. However, the lower door 17 is kept substantially in the closed state by the engaging mechanism 28, and further, a space between the lower door 17 and the front surface 31 of the washing chamber 3 is kept in the sealed state by the gasket.

Figure 8:
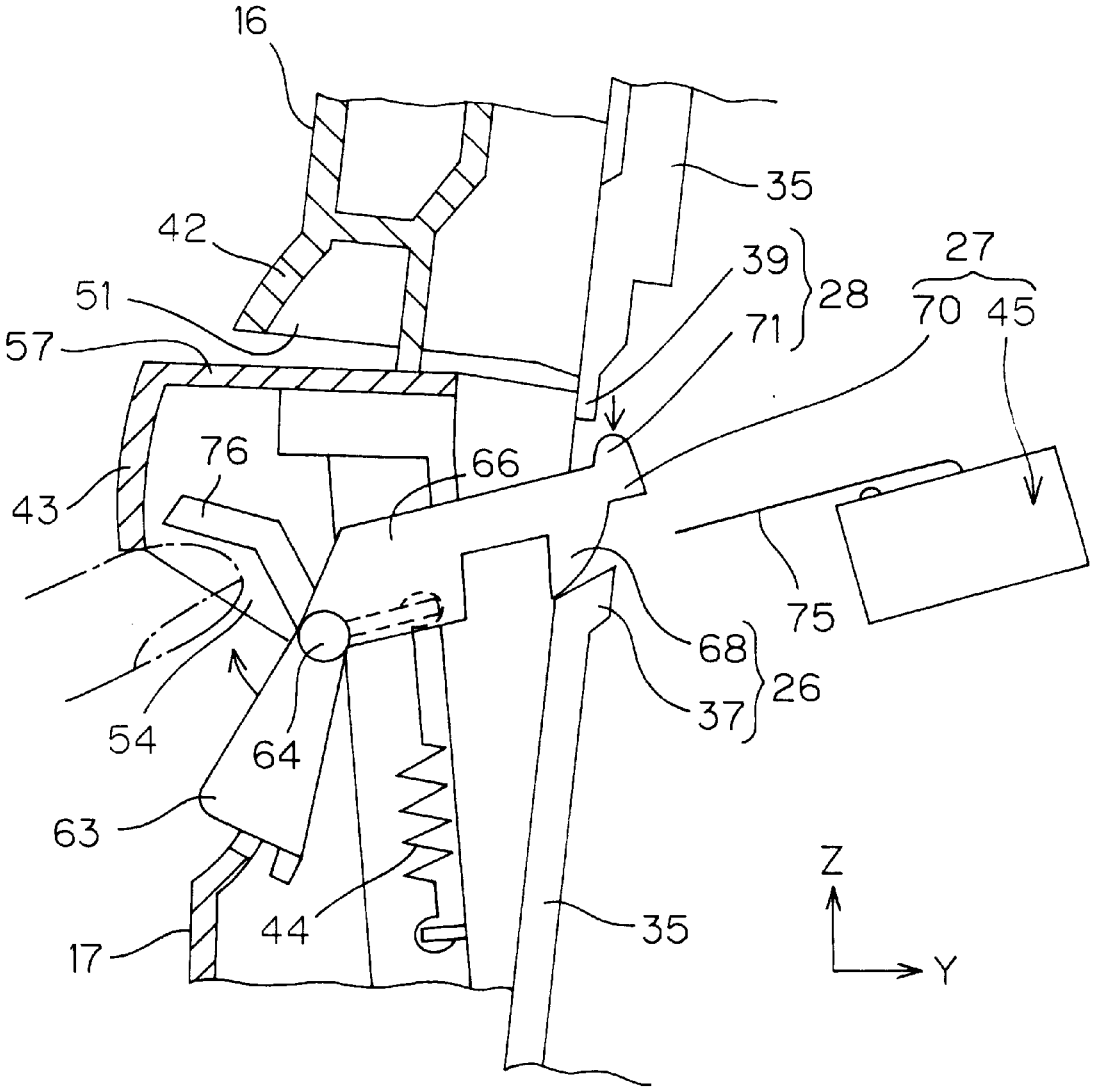

Further, as shown in FIG. 8, when the pushing on the push button 63 is stopped, the arm 66 is inclined to return to the lower position. However, since the lower door 17 is slightly opened by an elastic expansion force of the gasket, the locking mechanism 26 does not return to the locking state.—

Furthermore, in this embodiment, a user cannot open the lower door 17 by holding the handle 43 with fingers at the same time the push button 63 is pushed. This is because, if electric current flowing to the motor 13 is interrupted, the washing pump 10 may coast. And consequently, in order to prevent wash water from flowing out, the lower door 17 must not be opened while the coasting washing pump 10 is possibly spraying wash water.

A hindrance plate 76 (hindrance member) shown in FIGS. 5 to 8 prevents the simultaneous operations of the push button 63 and the handle 43.

The hindrance plate 76 is disposed in the recess 54 of the handle 43 of the lower door 17 and is connected to the push button 63. By pushing the push button 63, the hindrance plate 76 is pivotally moved about the shaft 64, 50 that the user cannot hold the handle 43 with fingers inserted into the depth of the recess 54, as shown in FIGS. 6 and 7. When the pushing the push button 63 is stopped, the shaft 64 is pivotally moved by spring force and the hindrance plate 76 is put into the depth of the recess 54 as shown in FIG. 8, so that the user can hold the handle 43. As a result, the lower door 17 can be opened forward.

Now, the upper door 16 will be described. As mentioned, the upper door 16 is pivotably supported by the pair of upper hinges 24. Only one of the upper hinges 24 will be described here, since the other hinge has a similar structure.

Figure 9:
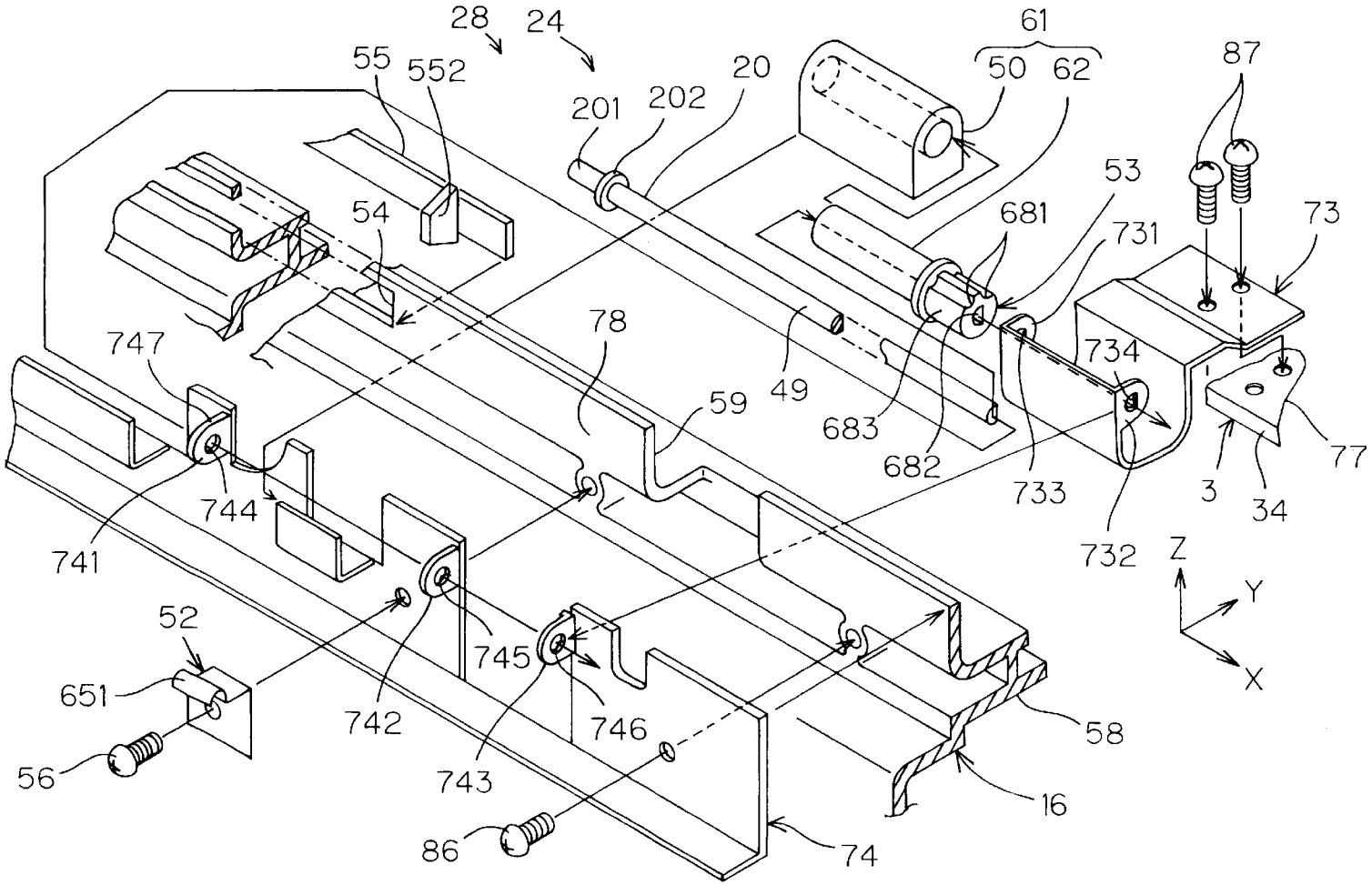
FIG. 9 is a partly exploded perspective view illustrating a supporting structure and an attaching structure of the upper door.

As shown in FIG. 9, the shaft 20 supporting the upper door 16 includes a pivotal movement controlling section 49, which is substantially D-shaped in section. The pivotal movement controlling section 49 is fitted into D-shaped through holes 733, 734 of the first support member 73. Therefore, the shaft 20, which is in the state of being prevented from rotating about its axis, is attached through the first support member 73 to an upper portion 34 of the washing chamber 3. Further, the shaft 20 is fitted into circular through holes 744 to 746 of the second support member 74 and attached through the second support member 74 to the upper door 16, so that the shaft 20 and the upper door 16 can be relatively rotated.

The upper door 16 can be stopped after being opened by predetermined angles (about 180 degrees and 150 degrees), as mentioned above with reference to FIG. 3C. For this purpose, the upper door 16 is provided with a stop mechanism 21 for increasing resistance against the pivotal movement of the upper door 16 at the abovementioned stop positions.

As shown in FIGS. 9 to 12, the stop mechanism 21 includes a flat spring 52 and a cam 53, which are relatively shifted interlockingly with the pivotal movement of the upper door 16 to become engaged with each other. The flat spring 52 is fixed to the upper door 16 by screws 56, and is provided with a semicircular protruded portion 651. The cam 53 has a D-shaped through hole 682, through which the pivotal movement controlling section 49 is penetrated so as to rotate integrally with the shaft 20. On a circumferential surface 683 of the cam 53, two recessed portions 681 semicircular in section are provided. Positions of the recessed portions 681 correspond to the stop positions of the upper door 16. Through engagement of the protruded portion 651 of the flat spring 52 with each of the recessed portions 681 of the cam 53, the pivotal movement of the upper door 16 is controlled. Resiliency of the flat spring 52 is set so strong as affords to keep its engagement with each of the recessed portions 681 against a torque of the pivotal movement of the upper door 16 by the own gravity thereof.

With the abovementioned arrangement of the stop mechanism 21, an operator is provided with a click feeling. By this click feeling, the operator can confirm that the upper door 16 has come to a pivotal movement stop position.

Figure 13:
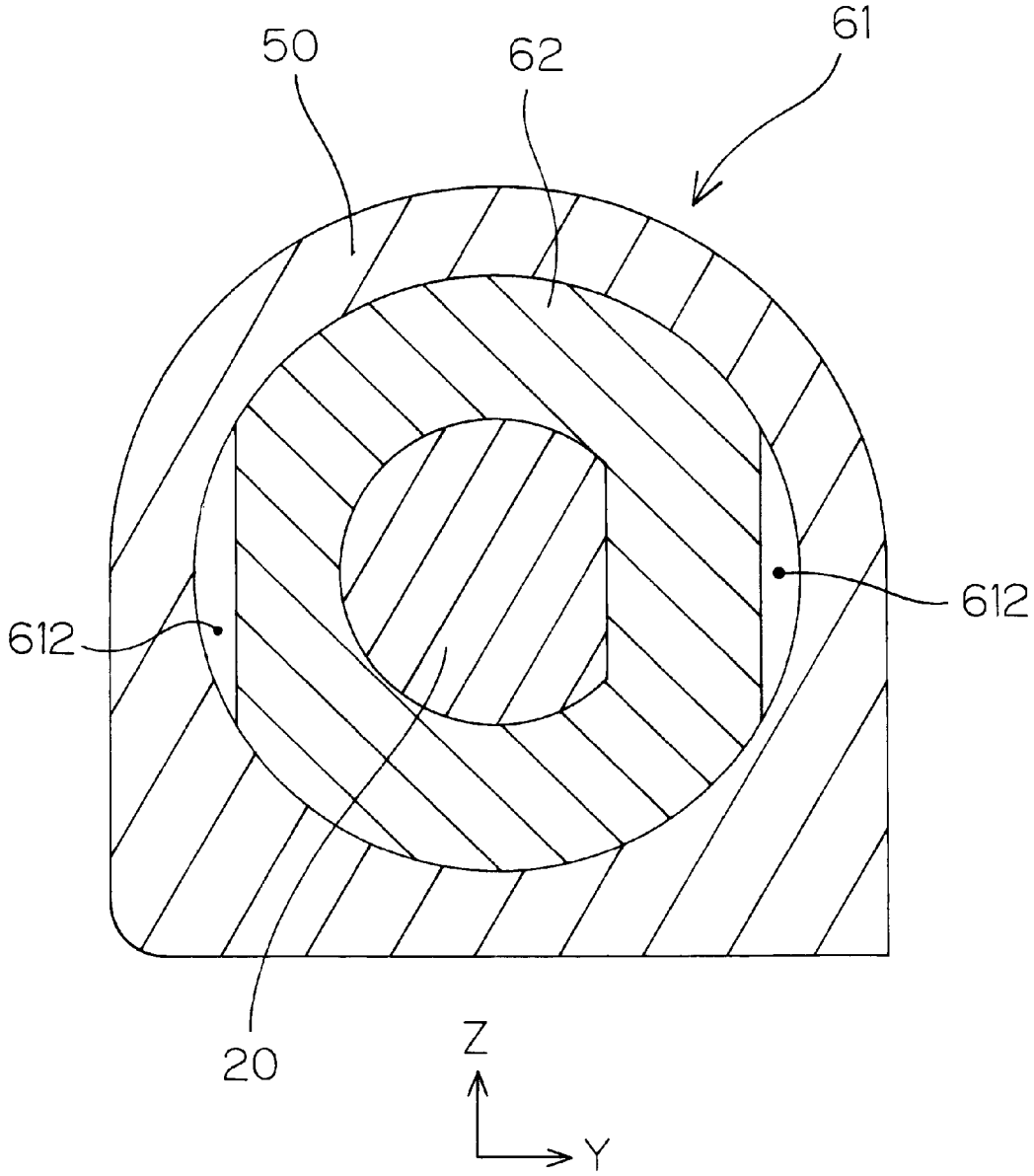
FIGS. 13 and 14 are sectional views illustrating embodiments of oil dampers.

Further, the upper hinge 24 is provided with an oil damper 61 for increasing resistance against its pivotal movement. As shown in FIG. 13, the oil damper 61 comprises a rotation member 62 pivotally movable integrally with the shaft 20, and a cylindrical member 50 fitted with the rotation member 62 thereinto and fixed to the upper door 16. As shown in FIG. 9, the rotation member 62 is formed integral with the cam 53 and disposed coaxially with and adjacent to the cam 53 in the direction of the axis of the shaft 20. The outer circumferential surface of the rotation member 62 has a pair of planes and a pair of circumferential surfaces connecting the pair of the planes with each other. With the rotation member 62 being fitted into the cylindrical member 50, oil reservoirs 612 are formed between the inner circumferential surface of the cylindrical member 50 and the planes of the rotation member 62. These oil reservoirs 612 are filled with an operating fluid such as grease. A viscosity of the operating fluid gives a resistance against the pivotal movement to the relative rotation of the cylindrical member 50 and the rotation member 62. Further, as the speed of the pivotal movement of the upper door 16 increases, the resistance against the pivotal movement becomes large.

Figure 14:
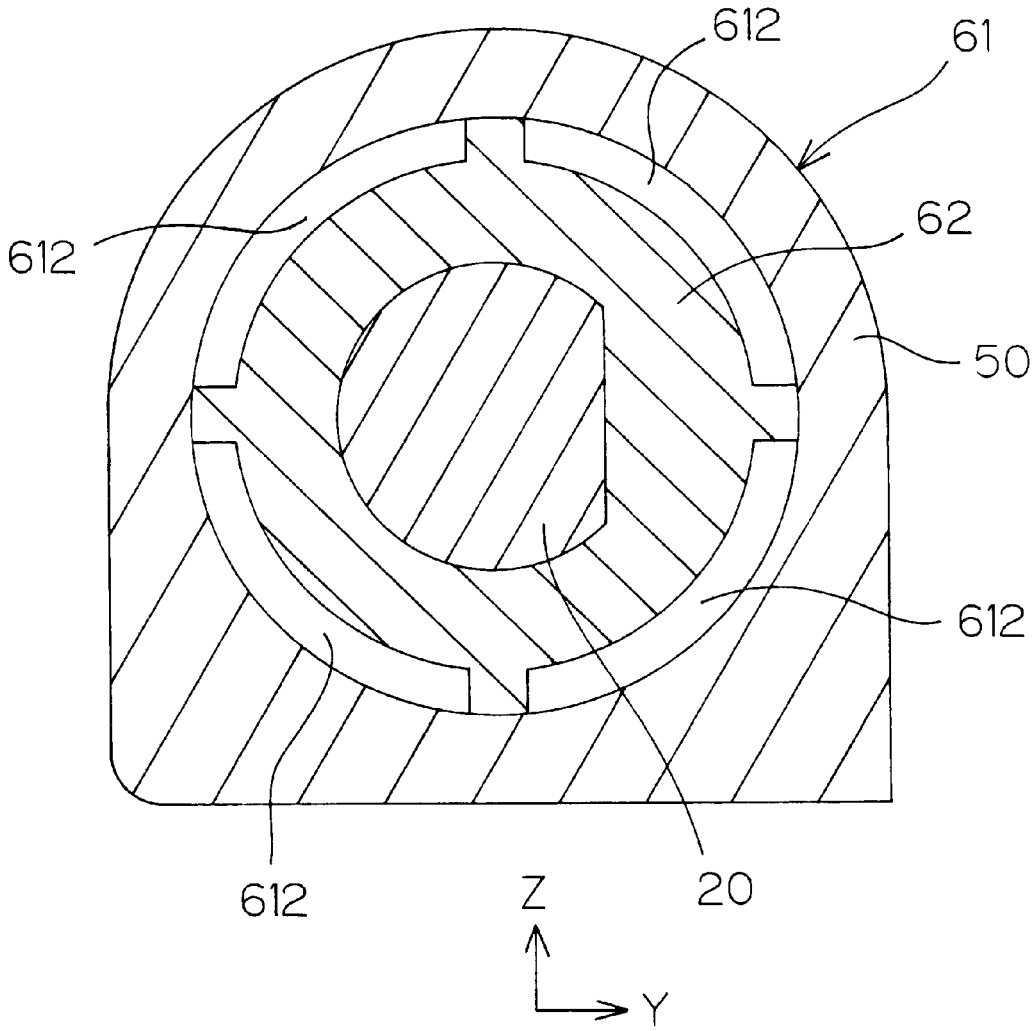
Figure 15A:
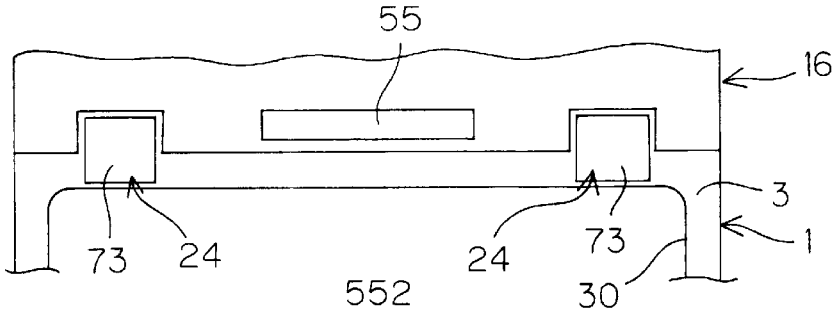
FIGS. 15A to 15D are diagrams explaining operations in detaching the upper door.
Figure 15B:
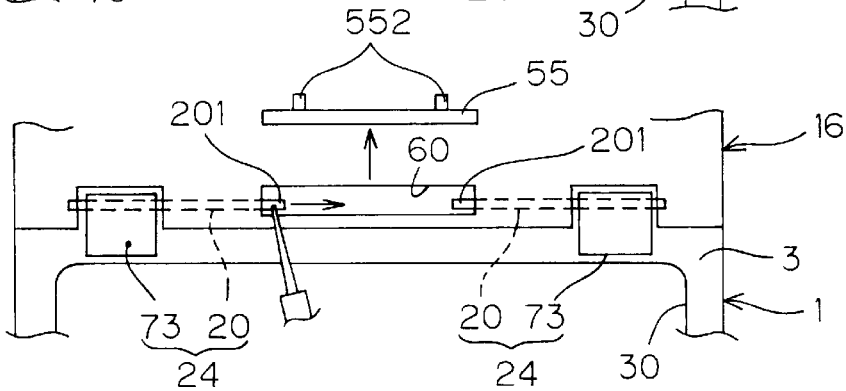
Figure 15C:
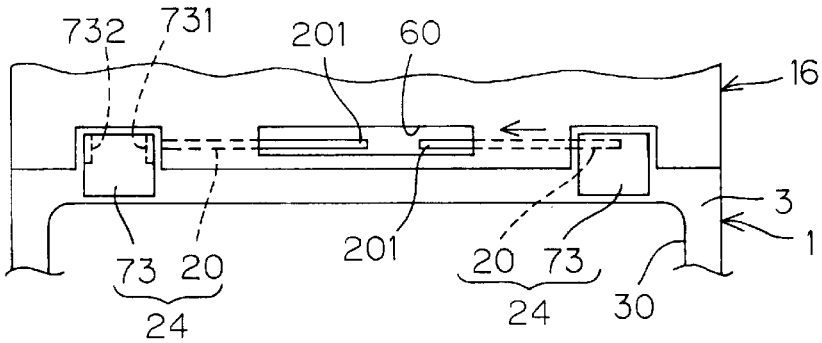
Figure 15D:
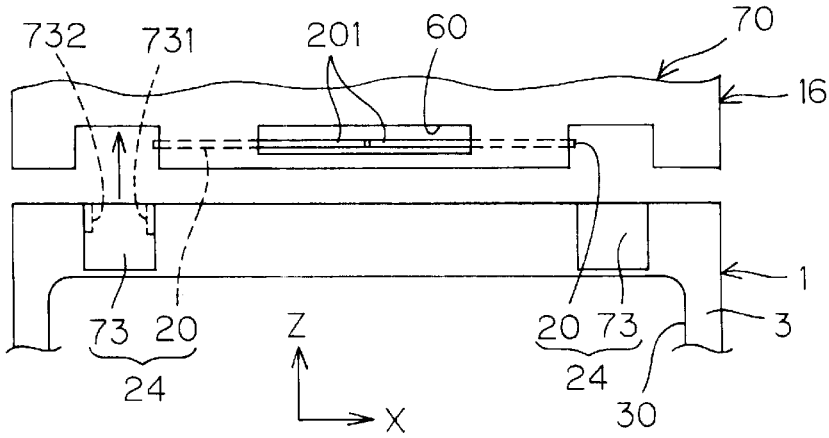

The rotation member 62 of the oil damper 61 may have a plural number of oil reservoirs 612 on its outer circumferential surface, as shown in FIG. 14.

The height (L2 of FIG. 3C) of the uppermost part of the upper door 16 opened by an angle of 150 degrees is lower than the height (L1 of FIG. 3C) of the uppermost part of the upper door 16 opened by an angle of 180 degrees (L2<L1). As a result, the dish washing machine 1 can be installed even in a space in which the upper door 16 of the dish washing machine 1 cannot be fully opened.

Further, the upper hinges 24 support the upper door 16 in such a manner that the upper door 16 can be easily detached from the washing chamber 3 as described in the following.

A fixing section 77 for fixing the first support member 73 is provided on the upper part 34 of the washing chamber 3, and another fixing section 78 for fixing the second support member 74 is provided on the upper part 58 of the upper door 16. These fixing sections 77, 78 are threaded with female screw holes and screws 56, 86, 87 are screwed in the female screw holes for fixing the first support member 73 and the second support member 74. The first support member 73 and the second support member 74 are connected through the shaft 20 with each other and support the shaft 20 so that the shaft 20 can be shifted in its axial direction.

The first support member 73 has a pair of support portions 731, 732 provided with through holes 733, 734 respectively through which the shaft 20 is penetrated. These support portions 731, 732 are spaced with a predetermined distance from each other in the axial direction of the shaft 20.

The second support member 74 has, for example, three support portions 741 to 743 provided with through holes 744 to 746 respectively through which the shaft 20 is penetrated. The support potions 741 to 743 are arranged with a predetermined distance therebetween in the axial direction of the shaft 20. The pair of support portions 731, 732 of the first support member 73 are interposed between the support portions 742 and 743.

The shaft 20 is longer than the distance between the support portions 741 and 743 provided respectively at both ends of the second support member 74. Further, in the state fitted with the cam 53 and the rotation member 62 of the oil damper 61, the shaft 20 can be detached from the first support member 73.

By axially displacing the shaft 20 supported by the second support member 74, the shaft 20 can be connected with and detached from the first support member 73. As a result, the shaft 20 can be connected with and detached from the first support member 73 and the second support member 74. By displacing, in one axial direction, each of the pair of the shafts 20 provided on both sides of the upper door 16, the shaft 20 can be detached from the first support member 73 and the upper door 16 can be detached from the washing chamber 3. Further, by displacing each of the shafts 20 in the other axial direction, the shaft 20 can be connected with the first support member 73 and the upper door 16 can be attached to the washing chamber 3.

Now, detailed description will be given with reference to FIG. 9 and FIGS. 15A to 15D. In the back surface of the upper part 58 of the upper door 16, is a service hatch 60 used for axially displacing the shafts 20.

When the upper door 16 is closed, the service hatch 60 is rearward opposed to the peripheral part of the opening 30 of the washing chamber 3. When the upper door 16 is fully opened, the service hatch 60 is directed forward and operable from the front position. The service hatch 60 is usually covered with a lid 55 (see FIG. 15A). The lid 55 is detachable by a predetermined tool and the service hatch 60 is prevented from being opened by an accustomed user. When the upper door 16 is fully opened and then the service hatch 60 is opened by detaching the lid 55, respective end portions 201 of the pair of the shafts 20 are exposed. The end portions 201 of the shafts 20 are moved to one axial direction (direction in which the left and right shafts 20 come near to each other) by a tool or the like (see FIG. 15B). Thereby the shaft 20 is detached from the support portions 731, 732 of the first support member 73 but supported by the two support portions 741, 742 of the second support member 74. As a result, the connection between the first support member 73 and the second support member 74 is released. By carrying out these operations with respect to the right and left shafts 20 (see FIG. 15C), the upper door 16 can be detached from the washing chamber 3 (see FIG. 15D).

In such a manner as abovementioned, the upper door 16 can be attached and detached without disassembling the cabinet 2 or the upper door 16. The upper door 16 can be attached to the washing chamber 3 by carrying out the abovementioned operations in reverse order.

Further, each shaft 20 is provided with control members 552, 747, 202. These control members 552, 747, 202 prevent axial displacement of the shaft 20 in the state supported by the first and the second support members 73, 74.

The control member 552 is provided on the lid 55. When the lid 55 is attached to the service hatch 60, the control member 552 is in contact with an end part 201 of each shaft 20 (front end part of each shaft 20 in the direction of displacement for detaching the upper door 16) and hinders the shaft 20 from moving.

The control member 747 is formed integral with the support portion 741 of the second support member 74. Through an engagement of the control member 747 with a flange (control member) 202 fitted on a predetermined position of the shaft 20, the control member 747 hinders the shaft 20 from moving in the other axial direction.

Now, the sealing member 81 for sealing the space between the upper door 16 and the lower door 17 will be described in the following.

Figure 16:
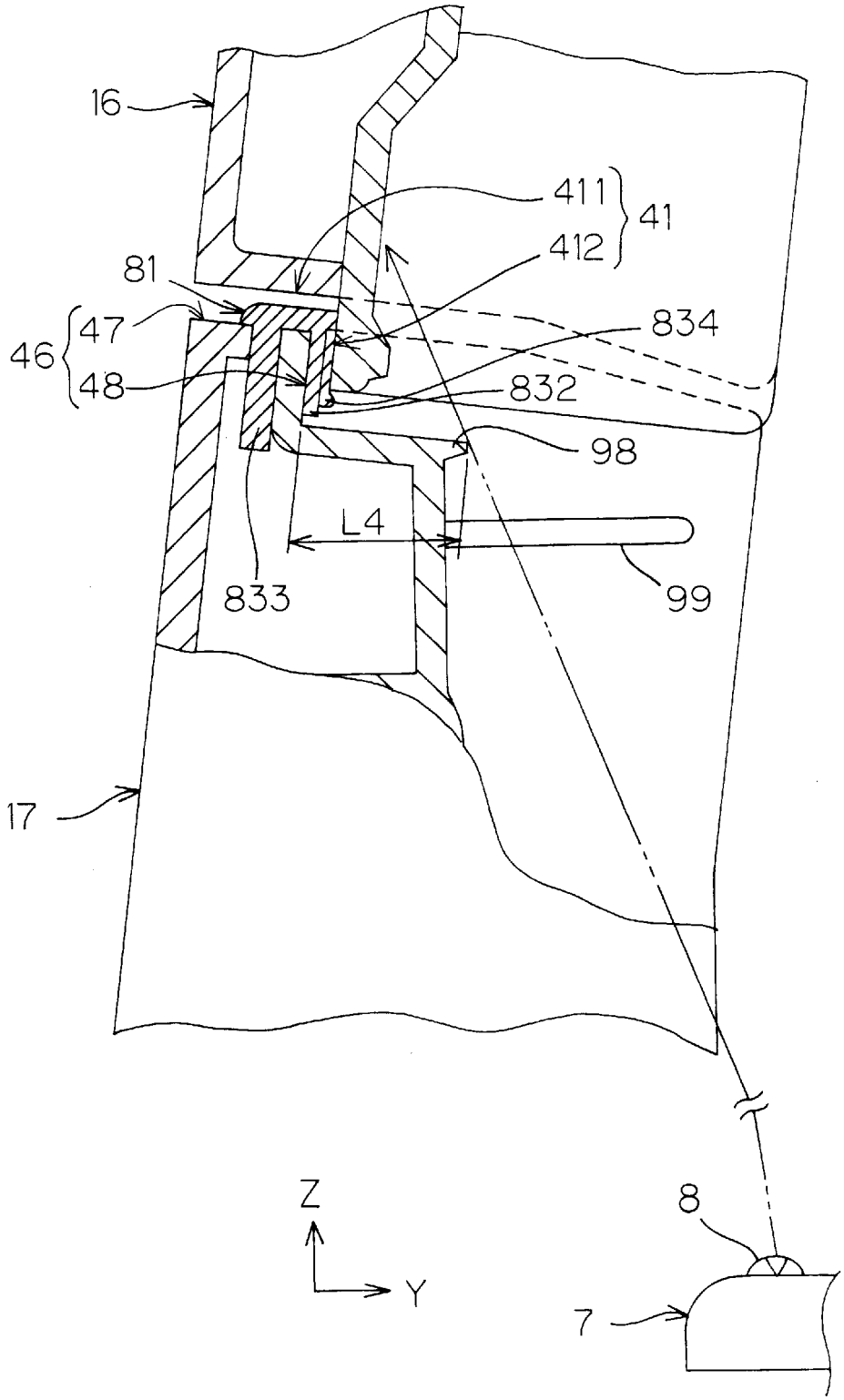
FIG. 16 is a view illustrating a structure of a sealing member for sealing between the upper door and the lower door.
Figure 17:
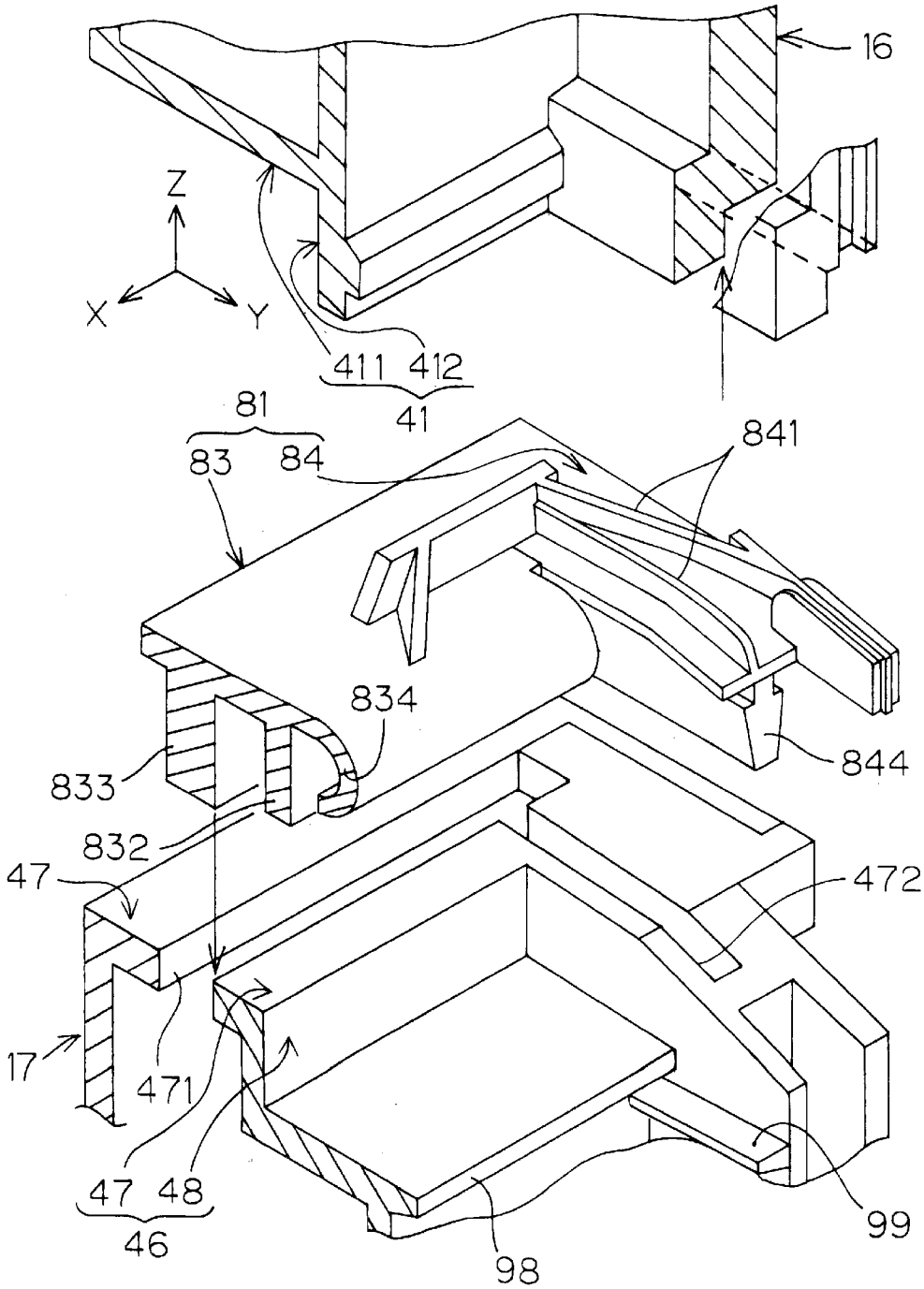
FIG. 17 is a partly exploded perspective view illustrating a structure of the sealing member.

As shown in FIGS. 16 and 17, the sealing member 81 is provided between the lower edge of the upper door 16 and the upper edge of the lower door 17. The upper edge of the lower door 16 is provided with a fixing section 46 for fixing the sealing member 81, and the lower edge of the upper door 16 is provided with a holding section 41 for holding the sealing member 81. When the upper door 16 and the lower door 17 are closed, the sealing member 81 is held between the upper door 16 and the lower door 17 and tightened, so that the sealing member 81 fluid-tightly seals the space between the upper door 16 and the lower door 17.

The sealing member 81 is formed of an elastic material such as rubber. The sealing member 81 has a main part 83 extending from the right side to the left side (in the X direction) and a pair of end parts 84 extending rearward (in the Y direction) from both sides of the main part 83. The main part 83 and the pair of end parts 84 are formed integral.

The fixing section 46 has a substantially horizontal upper surface 47 on the uppermost part of the lower door 17 in the closed state, and a receiving surface 48 extending downward from the rear edge of the upper surface 47. The upper surface 47 is provided with a fixing opening 471 into which the sealing member 81 is fitted and fixed.

When the upper door 16 is in the closed state, the holding section 41 has a substantially horizontal lower surface 411 and a holding surface 412 extending downward from the rear edge of the lower surface 411. The holding surface 412 is opposed to the receiving surface 48 of the lower door 17 and holds the sealing member 81 between the receiving surface 48. The lower surface 411 is opposed to the upper surface 47 in such a manner that the space therebetween decreases in the rearward direction (Y direction).

The sealing member 81 has a rib 833 extending downward from the main part 83 so as to be fitted into the fixing opening 471, a rib 832 for contacting with the receiving surface 48 and a curved rib 834 provided behind the rib 832.

When the upper door 16 and the lower door 17 are in the closed state, the receiving surface 48 of the lower door 17, the rib 832 and the curved rib 834 of the sealing member 81 and the holding surface 412 of the upper door 16 are overlapped. When the lower door 17 is closed, the curved rib 834 of the sealing member 81 is elastically deformed and seals, together with the rib 832, a space between the receiving surface 48 and the holding surface 412.

One end of the upper surface 47 of the lower door 17 extends rearward and is provided with a fitting opening 472 there. A pawl 844 of the sealing member 81 is fitted into this fitting opening 472, and the end parts 84 of the sealing member 81 are surely fixed to the lower door 17. A rib 841 is protruded upward from the upper surface of the end part 84 of the sealing member 81 and elongated round from the front to the back. The rib 841 prevents water leakage at the sides.

Further in this embodiment, in order to heighten the sealing quality of the sealing member 81, the lower door 17 has such a structure as described below with reference to FIGS. 16 and 18.

In order to prevent the sealing member 81 from being directly sprayed with water through nozzles 8, the lower door 17 is provided with a protective wall 98 projecting rearward from the sealing member 81 by a distance L4.

Water sprayed toward the sealing member 81 is interrupted by the protective wall 98 and does not reach the sealing member 81. As a result, sealing quality of the sealing member 81 can be heightened.

Figure 18:
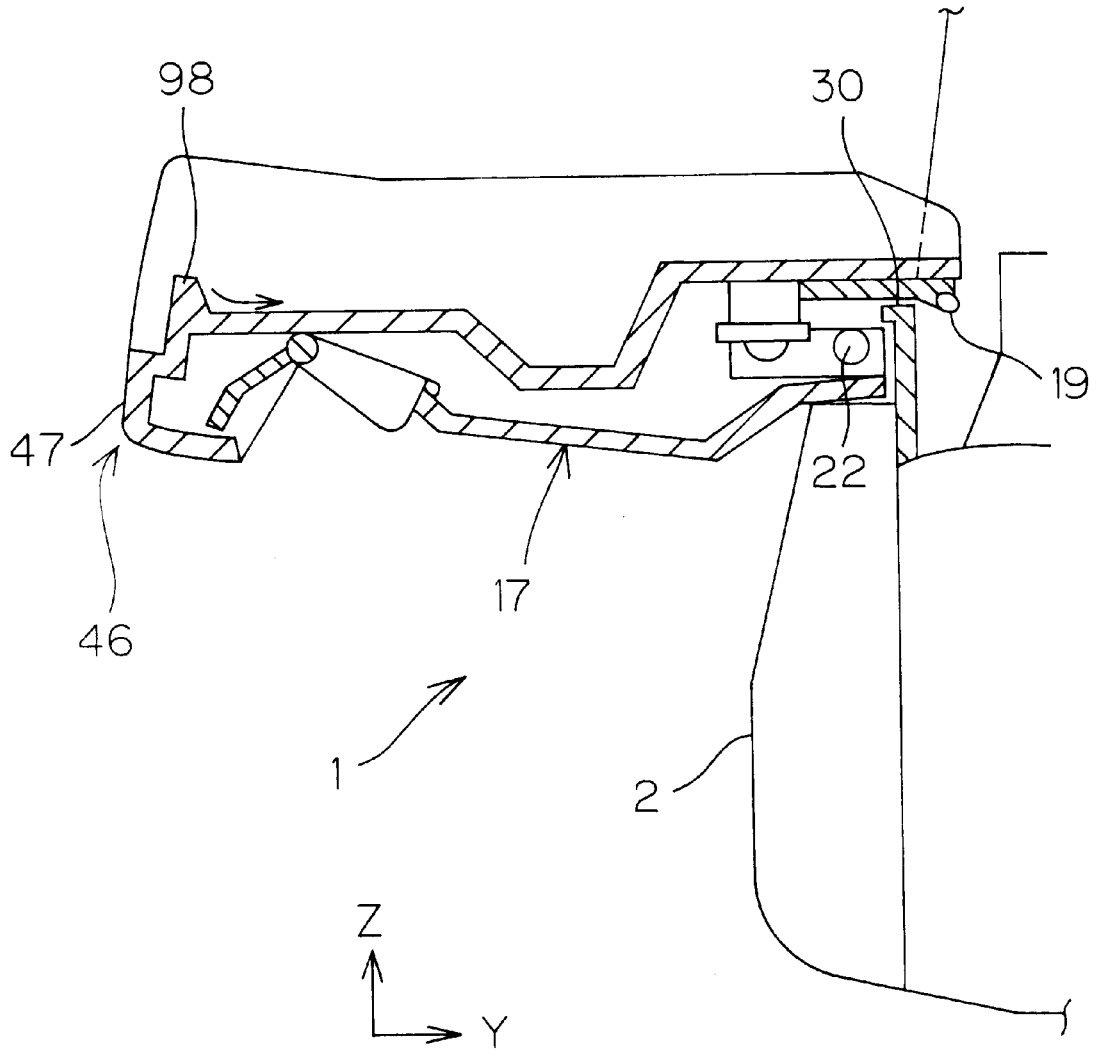
FIG. 18 is a sectional side view of the lower door being in the opened state.

Further, when the lower door 17 is opened, water-drops attached to the inner surface of the lower door 17 can be prevented from flowing down forward by the protective wall 98, of which a tip end is formed as a projected column as shown in FIG. 18.

Furthermore, in order to prevent the end parts 84 of the sealing member 81 from being directly sprayed with water through nozzles 8, hindrance plates 99 are provided on both sides of the inner surface of the lower door 17, as shown in FIGS. 16 and 17.

Figure 19:
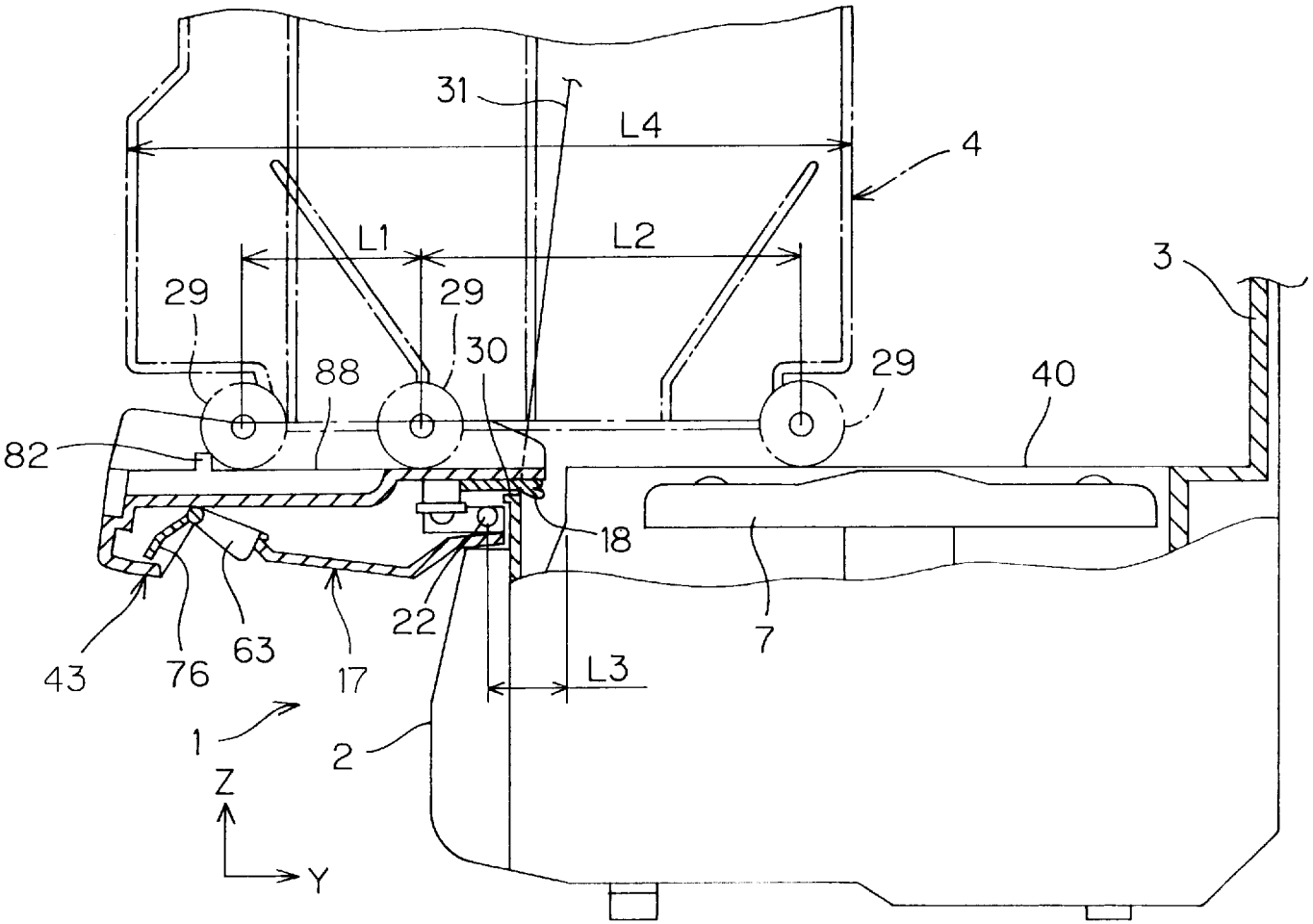
FIGS. 19 and 20 are views illustrating two types of baskets which are pulled out onto the lower door.

In the dish washing machine 1 according to the present invention, the basket 4 can be pulled out of the washing chamber 3 onto the lower door 17, as shown in FIG. 19. For this purpose, on the side surfaces of the washing chamber 3 are rails 40 on which the basket 4 is mounted. These rails 40 extend substantially horizontally from the back to the front inside the washing chamber 3. Further, on the back surface of the lower door 17 are rails 88 on which the basket 4 is mounted. The rails 88 on the lower door 17 are adjacent to and at substantially the same height as the front ends of the rails 40 in the washing chamber 3. Thereby, the rails 40 in the washing chamber 3 and the rails 88 on the lower door 17 are continuously connected, so that the basket 4 can smoothly moved on these rails 40, 88.

Stoppers 82 are disposed on the rails 88 on the lower door 17. The stoppers 82 control the pull-out position of the basket 4. Therefore, when the basket 4 is pulled out, the dish washing machine 1 is prevented from falling down forwardly.

At the bottom of the basket 4, wheels 29 are provided. Three wheels 29 are attached to each of the right and the left side of the basket 4. The wheels 29 are so arranged as to stably support the basket 4 placed astride over the washing chamber 3 and the lower door 17. The distance L1 between each wheel 29 in the front row and each wheel 29 in the intermediate row is longer than the distance L3 between the shaft 22 and the front end of the rail 40 in the washing chamber 3. The distance L2 between each wheel 29 in the intermediate row and each wheel 29 in the rear row is set to be longer than substantially half of the depth L4 of the basket 4 so that only these wheels 29 can stably support the basket 4 even if the front wheels 29 are not in contact with the rail.

Usually, dishes are put in and out of the basket 4 in the state where the basket is pulled to the forefront position on the lower door 17. At this time, since more than the front half part of the basket 4 is opened upward, large-sized dishes can be easily put in and out of the basket 4.

Further, in the dish washing machine 1 according to the present invention, the washing pump 10 is disposed in the rear part of the machine 1 as shown in FIG. 1. Therefore, the dish washing machine 1 is prevented from falling down. For example, the central portion of the washing pump 10 is disposed behind the substantially central position of the cabinet 2.

Further, the motor 13 is disposed in a position similar to that of the washing pump 10. The washing pump 10 and the motor 13 are heavy. So, with a washing pump 10 and a motor 13 disposed in the rear part of the dish washing machine 1, a dish washing machine 1 can be realized which is prevented from falling down and may be stably used when the upper and the lower doors 16,17 are opened and the basket 4 is pulled out forward.

Figure 20:
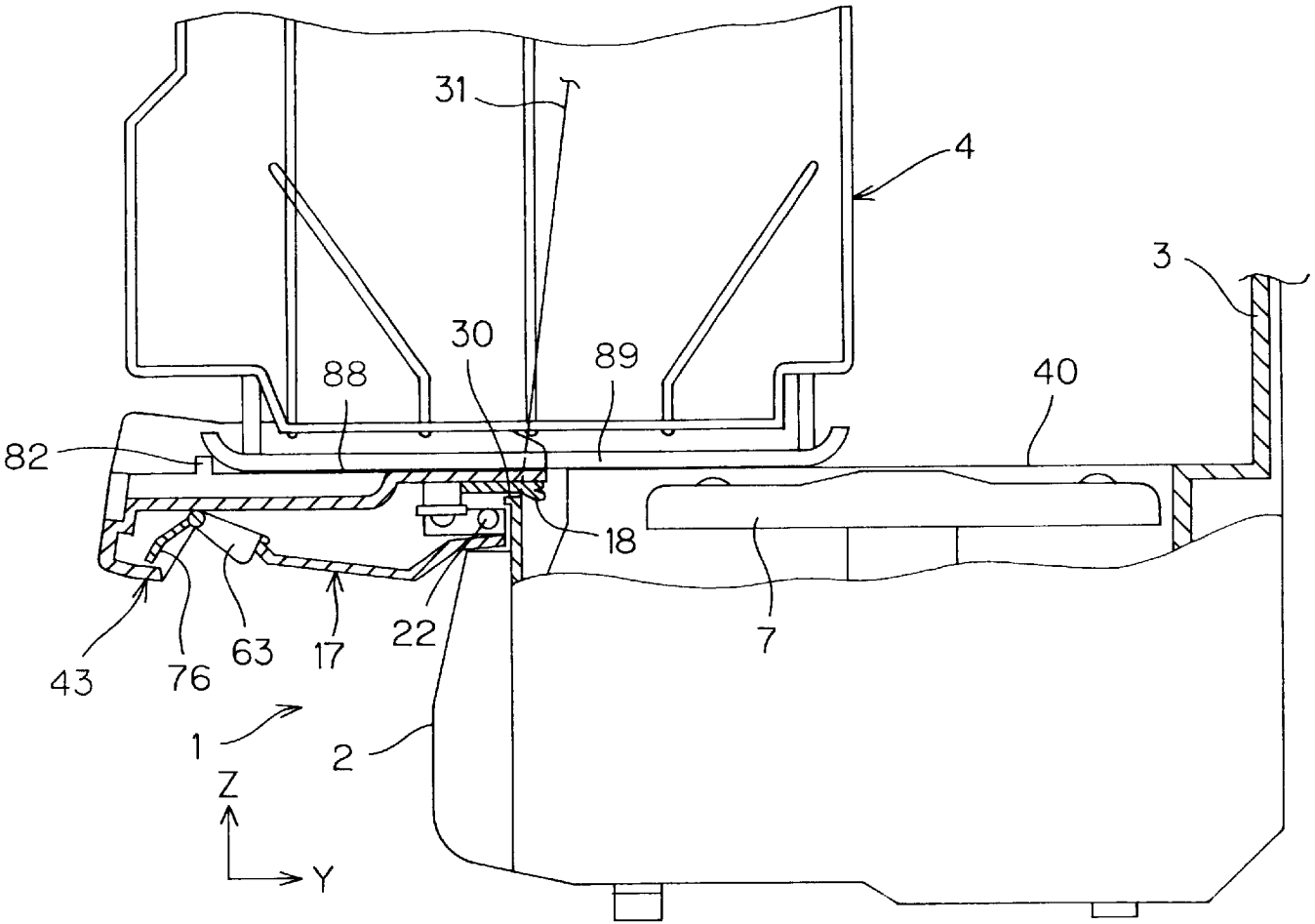

Instead of the wheels 29, sleighs 89 may be provided under the basket 4 as shown in FIG. 20. The shape of the sleighs 89 are not limited to the one illustrated in FIG. 20, but legs having R-shaped lower parts may be used. Further, a sleigh or R-shaped legs and wheels may be used together. Furthermore, the positions of the wheels and legs in the direction of depth of the machine 1 may be different respectively on the right and left sides of the basket 4.

Although there has been illustrated and described about an dish washing machine of the present invention, this invention should not be limited to the embodiment above. Various modifications in design are possible within the scope of the appended claims.

What is claimed is:

1. A dishwashing machine, comprising:

a washing chamber having an opening at a front thereof;

an upper door having shafts at an upper portion thereof, said upper door being opened through an upward pivotal movement thereof about its respective shafts, said upper door further including a handle at a lower portion thereof, said handle being operatable for opening and closing of said upper door; and a lower door having shafts at a lower portion thereof, said lower door being opened through a downward pivotal movement thereof about its respective shafts, said lower door including an operation preventing member for making the handle inoperable when said lower door is closed;

the upper door and said lower door collectively covering the opening, said upper door and said lower door being vertically arranged, with said upper door being disposed above said lower door; and said upper door and said lower door being configured so that said upper door can be opened after said lower door is opened, and so that said lower door can be closed after said upper door is closed.

2. A dish washing machine as claimed in claim 1, wherein the lower door includes a locking mechanism for keeping the lower door closed.

3. A dish washing machine as claimed in claim 2, further comprising a switch mechanism for turning on/off a washing operation in the washing chamber in correspondence with a locking/releasing of the locking mechanism.

4. A dish washing machine as claimed in claim 3, wherein the lower door is provided with a handle to be held by a user for opening and closing the lower door, an operating member for releasing the locking mechanism, and a hindrance member for hindering a user from holding the handle of said lower door when the operating member is in operation.

5. A dish washing machine as claimed in claim 1, further comprising a basket positionable in said washing chamber; wherein the lower door is adapted for being opened to a substantially horizontal position, and in this opened state, the basket contained in the washing chamber is adapted to be pulled out and partly placed on the opened lower door.

6. A dish washing machine as claimed in claim 1, further comprising a stop mechanism disposed on each respective shaft of said upper door for stopping the upper door at a plural of opened positions.

7. A dish washing machine as claimed in claim 6, wherein the upper door is adapted to be stopped at an opened position reached after its pivotal movement substantially through 180 degrees from the closed position, and at another opened position reached after its pivotal movement substantially through 150 degrees therefrom.

8. A dish washing machine as claimed in claim 6, wherein the stop mechanism includes a pair of engaging members engaging with each other, one engaging member being provided on a side of the opening of the washing chamber and another engaging member being on a side of the upper door, and an engaging state of the pair of the engaging members changes with a state of the pivotal movement of the upper door.

9. A dish washing machine as claimed in claim 8, wherein the pair of the engaging members include a cam fitted onto the respective shaft of the upper door, and a flat spring to be pressed against a circumferential surface of the cam.

10. A dish washing machine as claimed in claim 6, wherein the stop mechanism includes an oil damper for increasing resistance against the pivotal movement of the upper door.

11. A dishwashing machine, comprising:

a washing chamber having an opening at a front thereof;

an upper door having shafts at an upper portion thereof, said upper door being opened through an upward pivotal movement thereof about its respective shafts;

a lower door having shafts at a lower portion thereof, said lower door being opened through a downward pivotal movement thereof about its respective shafts; and a sealing member disposed between said upper door and said lower door; the upper door and said lower door collectively covering the opening, said upper door and said lower door being vertically arranged, with said upper door being disposed above said lower door, so that when said upper door and said lower door are closed, an upper edge of said lower door and a lower edge of said upper door overlap each other in a width direction of the opening, with said sealing member being held between the overlapped edges to prevent water leakage between the overlapped edges.

12. A dish washing machine as claimed in claim 11, wherein the upper door is provided with means for detachably attaching the upper door to the opening of the washing chamber by axially sliding the shafts of the upper door.

13. A dish washing machine as claimed in claim 11, wherein a protective wall that projects rearward from said sealing member is provided in the washing chamber for preventing the sealing member from being directly sprayed with sprayed water.

14. A dish washing machine as claimed in claim 11, wherein the washing chamber is so shaped that its width is long and its depth is short.

15. A dish washing machine as claimed in claim 11, wherein the shafts of the upper door are provided more rearward than the shafts of the lower door so that a most front edge of the upper door is positioned behind a front edge of the lower door in their respective opened states.

* * * * *